US009372437B2

(12) United States Patent
Yasumoto et al.

(10) Patent No.: US 9,372,437 B2
(45) Date of Patent: Jun. 21, 2016

(54) DEVELOPING DEVICE HAVING DEVELOPER COATING REGULATION

(71) Applicant: CANON KABUSHIKI KAISHA, Tokyo (JP)

(72) Inventors: Takeshi Yasumoto, Abiko (JP); Dai Kanai, Abiko (JP); Koichi Watanabe, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/190,216

(22) Filed: Feb. 26, 2014

(65) Prior Publication Data

US 2014/0255061 A1 Sep. 11, 2014

(30) Foreign Application Priority Data

Mar. 5, 2013 (JP) ..... 2013-042703

(51) Int. Cl.
*G03G 15/08* (2006.01)

(52) U.S. Cl.
CPC ..... *G03G 15/0812* (2013.01)

(58) Field of Classification Search
None
See application file for complete search history.

(56) References Cited

U.S. PATENT DOCUMENTS 5,072,690 A * 12/1991 Ishikawa et al. ..... 399/275
5,483,322 A 1/1996 Otome et al.
7,289,755 B2 10/2007 Terai
8,559,856 B2 10/2013 Suzuki et al.
8,655,237 B2 2/2014 Suzuki et al.
8,670,698 B2 * 3/2014 Park ..... 399/274
2005/0013627 A1 1/2005 Jeon
2010/0129120 A1 5/2010 Senda et al.
2012/0039638 A1 2/2012 Park

FOREIGN PATENT DOCUMENTS

JP S53-119049 A 10/1978
JP H08-171282 A 7/1996
JP 2003-057594 A 2/2003

(Continued)

OTHER PUBLICATIONS

Russian Decision on Grant dated Aug. 17, 2015, in related Russian Patent Application No. 2014108440 (with English translation.

(Continued)

*Primary Examiner* — David Gray
*Assistant Examiner* — Geoffrey Evans
(74) *Attorney, Agent, or Firm* — Fitzpatrick, Cella, Harper & Scinto

(57) ABSTRACT

A developing device includes a developer sleeve, a regulating portion including an edge portion at a closest position to a surface of the sleeve or a flat portion tilted, at the closest position, by an angle of 2 degrees or less relative to a contact flat plane contacting the surface of the sleeve, and a rectifying portion connected with the edge or flat portion. The rectifying portion has a concavely curved surface such that a rate of a decrease in a gap between the rectifying portion and the contact flat plane increases toward a downstream side of the developer feeding direction and is formed by smoothly connecting rectilinear or curved lines each of 0.2 mm or less except for the edge portion so that the gap between the rectifying portion and the contact flat plane monotonically decreases toward the downstream side of the developer feeding direction.

24 Claims, 11 Drawing Sheets

(56) References Cited

FOREIGN PATENT DOCUMENTS

| | | | |
|---|---|---|---|
| JP | 2004-184941 | A | 7/2004 |
| JP | 2005-215049 | A | 8/2005 |
| JP | 2005-275069 | A | 10/2005 |
| JP | 2006-098854 | A | 4/2006 |
| JP | 2007-147915 | A | 6/2007 |
| JP | 2009-134167 | A | 6/2009 |
| JP | 2010-127980 | A | 6/2010 |
| JP | 2012-108466 | A | 6/2012 |

OTHER PUBLICATIONS

Chinese Office Action dated Feb. 19, 2016, in related Chinese Patent Application No. 20140077854 (with English translation.

Korean Office Action dated Mar. 10, 2016, in related Korean Patent Application No. 10-2014-0023950.

* cited by examiner (a)

(b)

DEVELOPING DEVICE HAVING DEVELOPER COATING REGULATION

FIELD OF THE INVENTION AND RELATED ART

The present invention relates to a developing device for forming a visible image by developing an electrostatic latent image formed on an image bearing member by an electrophotographic type, an electrostatic recording type or the like, and particularly relates to a structure including a coating amounting portion for regulating a coating amount of a developer carried on a developer carrying member.

An image forming apparatus such as a copying machine, a printer, a facsimile machine or a multi-function machine of these machines conventionally includes the developing device for forming the visible image by developing the electrostatic latent image formed on a photosensitive drum as the image bearing member by the electrophotographic type, the electrostatic recording type or the like. Such a developing device carries and feeds the developer by a magnetic force at a surface of a developing sleeve as the developer carrying member. Then, a coating amount (layer thickness) of the developer on the developing sleeve surface is uniformized by a doctor blade as a coating amount regulating portion for regulating the coating amount of the carried developer, so that stable supply of the developer to the photosensitive drum (photosensitive member) is realized.

Here, in the case of such a developing device, the developer scraped off by the doctor blade is liable to stagnate in an upstream side of a gap between the doctor blade and the developing sleeve (hereinafter referred to as an "SB gap"). In this way, due to stagnation of the developer, an immobile layer and a fluidized layer of the developer are generated in the developing device, and at a boundary of these layers, the developer in an immobile layer side is always subjected to a shearing force and therefore is liable to generate melting and sticking due to heat. In this way, when the sticking is generated in the upstream side of the SB gap, the sticking portion scrapes off the developer on the surface of the developing sleeve, and therefore a uniformizing effect by the doctor blade cannot be obtained sufficiently, so that image defects such as density non-uniformity and stripes of the image obtained by the development are caused in some cases.

Therefore, a constitution in which a superfluous stagnation layer generated upstream of the SB gap by filling a space, where an effect of carrying the developer on the developing sleeve by the magnetic force in the upstream side of the SB gap is not readily produced, with a developer station limiting member is limited has been proposed (Japanese Laid-Open Patent Application (JP-A) 2005-215049).

However, in the case of the structure described in JP-A 2005-215049, a portion connecting the developer station limiting member and the doctor blade constitutes a stepped portion. Further, in general, the SB gap is subjected to the following adjustment for ensuring the SB gap with accuracy of, e.g., about ±30-50 μm in order to obtain an optimum development density. That is, as shown in FIG. 11, a constitution such that a projection amount of a doctor blade 73 to the developing sleeve 70 is adjusted and is fixed with an adjusting screw 75 to a developer station limiting member 76 as a base is employed. Here, in order to uniformize the development density with respect to a longitudinal direction, the SB gap is measured at a plurality of positions with respect to the longitudinal direction, and also the adjusting screw 75 is provided similarly at a plurality of positions with respect to the longitudinal direction.

In this way, the projection amount of the doctor blade 73 is adjusted and therefore as shown in (a) of FIG. 12, a connecting portion (seam) between the developer station limiting member 76 and the doctor blade 73 results in a stepped portion.

Here, by providing the developer station limiting member 76, a principal flow of the developer can be regarded as a flow of the developer carried and fed by the magnetic force of the developing sleeve 70 (i.e., a developer flow in a region toward the developing sleeve with a boundary indicated by an arrow Fm in (a) of FIG. 12, hereinafter simply referred to as a mainstream (main flow) Fm). However, a part of the mainstream Fm is cut at a stepped portion 77 between the developer station limiting member 76 and the doctor blade 73, and therefore another flow Fs obstructing the mainstream Fm (hereinafter simply referred to as a sidestream (side flow) Fs) is caused to be generated.

This sidestream Fs generates, as shown in (a) of FIG. 12, a circulating flow which forms a station layer in the upstream side of the doctor blade 73 and constitutes a shearing flow at a boundary between the mainstream Fm and the sidestream Fs. For this reason, the mainstream Fm is influenced by the sidestream Fs in the upstream side of the SB gap, so that the coating amount of the developer carried on the developing sleeve 70 is liable to be unstable and therefore a stable development density cannot be obtained in some cases.

On the other hand, in order to obtain a maximum feeding effect by the mainstream Fm, it would be considered that a flow path shape from the developer stagnation limiting member 76 to the SG gap G is formed in a streamline shape as shown in (b) of FIG. 12. However, in the case where such a constitution is employed, although the sidestream Fs as the circulating flow is almost eliminated, the influence of the mainstream Fm is excessively strong and therefore a change in coating amount of the developer on the developing sleeve 70 with respect to a change in SB gap G is extremely sensitive. That is, in the case where there is almost no generation of the sidestream, there is a need to severely control part accuracy and adjustment accuracy which are required for obtaining a desired coating amount.

SUMMARY OF THE INVENTION

The present invention has been accomplished in view of the above-described circumstances. A principal object of the present invention is to provide a developing device and a regulating member which are capable of realizing a structure by which a stable development density can be obtained without requiring high part accuracy and high adjustment accuracy.

According to an aspect of the present invention, there is provided a developing device comprising: a developer carrying member for carrying and feeding a developer; a regulating portion for regulating a coating amount of the developer carried on the developer carrying member, wherein the regulating portion includes an edge portion at a closest position to a surface of the developer carrying member or includes a flat portion tilted, at the closest position, by an angle of 2 degrees or less relative to a contact flat plane contacting the surface of the developer carrying member; and a rectifying portion for rectifying a flow of the developer, wherein the rectifying portion is connected with the edge portion or an upstream end of the flat portion in an upstream side of the regulating portion, with respect to a developer feeding direction, wherein in a cross section perpendicular to an axial direction of the developer carrying member, when coordinates are set such that the upper end of the flat portion or the edge portion is an origin E, a direction which is parallel to the contact flat plane and which is opposite to the developer feeding direction is a positive side of X-axis, a direction which is perpendicular to the X-axis and which extends away from the developer carrying member is a positive side of Y-axis, and a closest distance between the regulating portion and the developer carrying member is G, in a region where a component of the X-axis is 3G or less, the rectifying portion has a concavely curved surface such that a rate of a decrease in gap between the rectifying portion and the contact flat plane increases toward a downstream side of the developer feeding direction and is formed by smoothly connecting rectilinear lines each of 2 mm or less or curved lines each of 2 mm or less except for the origin E so that the gap between the rectifying portion and the contact flat plane is monotonically decreased toward the downstream side of the developer feeding direction.

According to another aspect of the present invention, there is provided a regulating member, provided opposed to a developer carrying member for carrying a developer, for regulating the developer to be coated on the developer carrying member, the regulating member comprising: a regulating portion for regulating a coating amount of the developer carried on the developer carrying member, wherein the regulating portion includes an edge portion at a closest position to a surface of the developer carrying member or includes a flat portion tilted, at the closest position, by an angle of 2 degrees or less relative to a contact flat plane contacting the surface of the developer carrying member; and a rectifying portion for rectifying a flow of the developer, wherein the rectifying portion is connected with the edge portion or an upstream end of the flat portion in an upstream side of the regulating portion, with respect to a developer feeding direction, wherein in a cross section perpendicular to an axial direction of the developer carrying member, when coordinates are set such that the upper end of the flat portion or the edge portion is an origin E, a direction which is parallel to the contact flat plane and which is opposite to the developer feeding direction is a positive side of X-axis, a direction which is perpendicular to the X-axis and which extends away from the developer carrying member is a positive side of Y-axis, and a closest distance between the regulating portion and the developer carrying member is G, in a region where a component of the X-axis is 3G or less, the rectifying portion has a concavely curved surface such that a rate of a decrease in gap between the rectifying portion and the contact flat plane increases toward a downstream side of the developer feeding direction and is formed by smoothly connecting rectilinear lines each of 2 mm or less or curved lines each of 2 mm or less except for the origin E so that the gap between the rectifying portion and the contact flat plane monotonously decreases toward the downstream side of the developer feeding direction.

These and other objects, features and advantages of the present invention will become more apparent upon a consideration of the following description of the preferred embodiments of the present invention taken in conjunction with the accompanying drawings.

DESCRIPTION OF THE EMBODIMENTS

First Embodiment

The First Embodiment of the present invention will be described with reference to FIGS. 1 to 7. First, a general structure of an image forming apparatus including a developing device in this embodiment will be described with reference to FIG. 1.

[Image Forming Apparatus]

Figure 1:
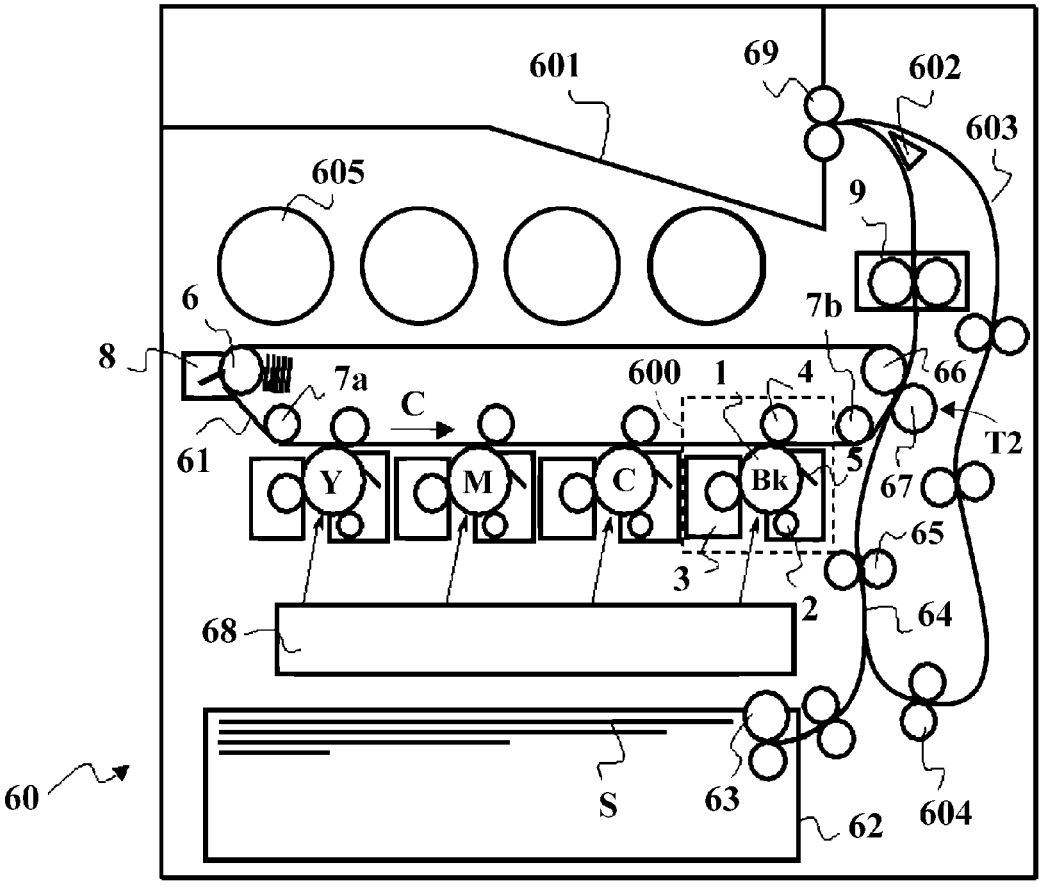
FIG. 1 is a schematic sectional view of an image forming apparatus including a developing device according to a First Embodiment of the present invention.

FIG. 1 is a sectional view of a color image forming apparatus of an electrophotographic type, and an image forming apparatus 60 is an example of the image forming apparatus of a so-called intermediary transfer tandem type in which image forming portions (process cartridges) 600 for four colors are provided opposed to an intermediary transfer belt 61. The intermediary transfer tandem type is a mainstream constitution in recent years from a viewpoint of high productivity and a viewpoint that it can meet feeding of various media.

A feeding process of a recording material S in such an image forming apparatus 60 will be described. The recording material S is accommodated in a recording material storage (cassette) 62 in a stacked manner, and is fed by a sheet feeding roller 63 at image forming timing. The recording material S fed by a sheet feeding roller 63 is fed to a registration roller 65 provided in a halfway position of a feeding path 64. Then, oblique movement correction and timing correction of the recording material S are made by the registration roller 65, and thereafter the recording material S is fed to a secondary transfer portion T2. The secondary transfer portion T2 is a transfer nip formed by opposing rollers consisting of a secondary transfer inner roller 66 and a secondary transfer outer roller 67, and a toner image is attracted to the recording material S by applying a predetermined pressure and a predetermined electrostatic load bias.

The feeding process of the recording material S to the secondary transfer portion T2 is described above. A formation method of an image sent to the secondary transfer portion T2 at the same timing will be described. First, the image forming portions 600 will be described, but the image forming portions 600 for respective colors basically have the same constitution except for the colors of toners, and therefore the image forming portion 600 for black (Bk) will be described as a representative.

The image forming portion 600 is constituted principally by a photosensitive drum (photosensitive member, image bearing member) 1, a charging device 2, a developing device 3, a photosensitive drum cleaner 5 and the like. A surface of the photosensitive drum 1 to be rotationally driven is electrically charged uniformly in advance by the charging device 2, and then an electrostatic latent image is formed by an exposure device 68 driven on the basis of an image information signal. Next, the electrostatic latent image formed on the photosensitive drum 1 is subjected to development with a toner by the developing device to be visualized. Thereafter, the toner image formed on the photosensitive drum 1 is primary-transferred onto the intermediary transfer belt 61 by providing a predetermined pressure and a predetermined electrostatic load bias by a primary transfer device 5 provided opposed to the image forming portion 600 via the intermediary transfer belt 61. A transfer residual toner remaining on the photosensitive drum 1 in a slight amount is collected by the photosensitive drum cleaner 5, and then is subjected to a subsequent image forming process. There are four sets of the image forming portions for yellow (Y), magenta (M), cyan (C) and black (Bk) in the case of the structure shown in FIG. 1. However, the number of the colors is not limited to 4, and also the order of arrangement of these image forming portions of the respective colors is not limited to the above order.

Next, the intermediary transfer belt 61 will be described. The intermediary transfer belt 61 is stretched by a tension roller 6, the secondary transfer inner roller 66 and follower rollers 7*a* and 7*b*, and is an endless belt to be fed and driven in an arrow C direction in FIG. 1. Here, the secondary transfer inner roller 66 also functions as a driving roller for driving the intermediary transfer belt 61. The image forming processes, for the respective colors, provided in parallel by the above-described respective image forming portions 600 for Y, M, C and Bk are performed at timing when the toner images are successively superposed on the upstream color toner images primary-transferred onto the intermediary transfer belt 61. As a result, a fall-color toner image is finally formed on the intermediary transfer belt 61 and then is fed to the secondary transfer portion T2. Incidentally, a transfer residual toner passing through the secondary transfer portion T2 is collected by a transfer cleaner device 8.

By the feeding process and the image forming process which are described above, respectively, timing of the recording material S and timing of the full-color toner image coincide with each other at the secondary transfer portion T2, where secondary transfer is effected. Thereafter, the recording material S is fed to a fixing device 9, where the toner image is melted and fixed on the recording material S by predetermined pressure and heat quantity. The thus image-fixed recording material S is subjected to selection such that the recording material S is discharged onto a discharge tray 601 as it is by normal rotation of a sheet discharging roller 69 or is subjected to double-side image formation.

In the case where there is a need to effect the double-side image formation, after a trailing end of the recording material S is fed until it passes through a switching member 602 by the normal rotation of the discharging roller 69, by reversely rotating the discharging roller 69, a leading end and the trailing end of the recording material S are interchanged and then the recording material S is fed to a feeding path 603 for the double-side image formation. Thereafter, the recording material S is fed again to the feeding path 64 by a feeding roller 604 for re-feeding with predetermined timing with a recording material, in a subsequent job, to be fed by the sheet feeding roller 63. Subsequent feeding and image forming processes for the image formation on the back (second) surface are the same as those described above and therefore will be omitted from description.

[Developing Device]

Next, the developing device 3 in this embodiment will be described with reference to FIGS. 2 and 3. In the developing device 3, as a developer, a two-change developer obtained by mixing the toner and a magnetic carrier is used. The toner is supplied from a toner cartridge 605 (FIG. 1) set in the image forming apparatus 60 into a developing container 30 via an unshown toner feeding path. In the developing container 30, a first feeding chamber 31 and a second feeding chamber 32 which are partitioned by a partition wall are provided and are connected with each other at their end portions with respect to a longitudinal direction. A first feeding screw 33 and a second feeding screw 34 are rotatably supported in the first feeding chamber 31 and the second feeding chamber 32, respectively, and are driven to circulate the fed toner through the two feeding chambers.

Here, the magnetic carrier is contained in advance in the developing container in the developing container 30, and the toner is sufficiently stirred with the magnetic carrier during the circulation in the first feeding chamber 31 to be triboelectrically charged, so that the toner and the magnetic carrier are fed to the second feeding chamber 32. The second feeding screw 34 in the second feeding chamber 32 is disposed opposed to a developing sleeve 70 as a developer carrying member and performs the function of feeding and supplying the toner, deposited on the magnetic carrier by the triboelectric charge with the magnetic carrier.

The developing sleeve 70 carries and feeds the developer by a magnetic force and has a constitution in which a magnet portion 71 where a pattern of magnetic poles for generating a desired magnetic field is provided therein and a sleeve pipe 72 is covered over an outside of the magnet portion 71. Here, the magnet portion 71 is supported in a non-rotational manner so that the magnetic pole pattern is fixed at a predetermined phase with respect to a circumferential direction, and only the sleeve pipe 72 is rotatably supported.

Figure 2:
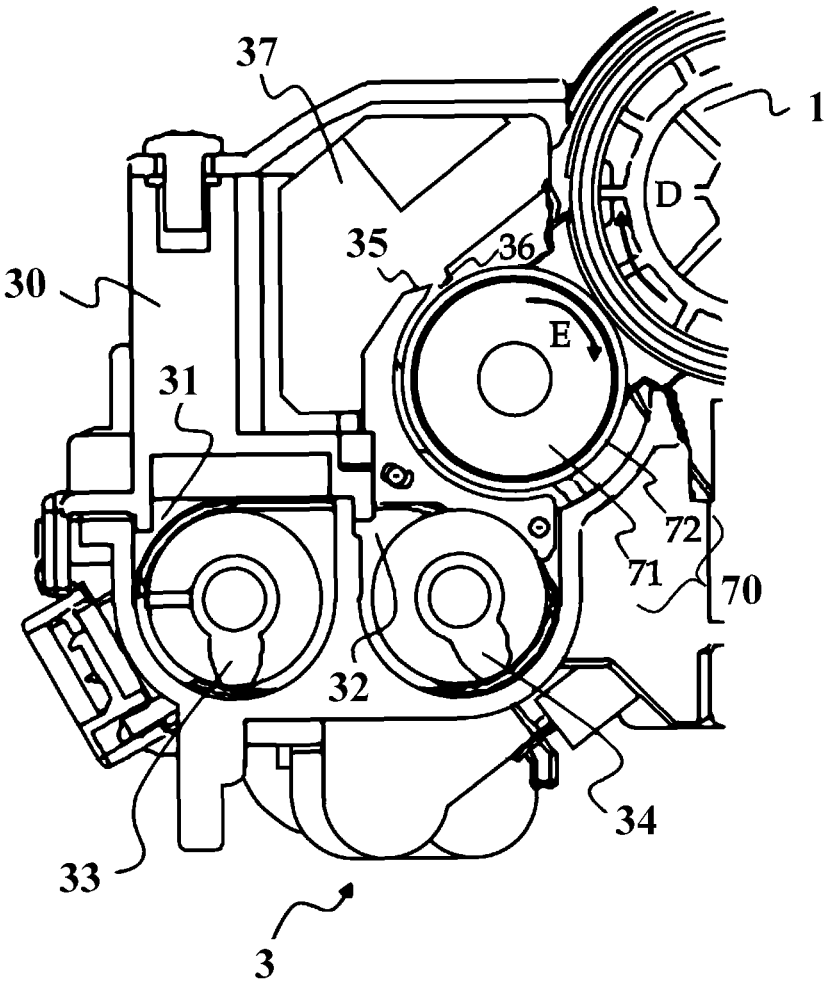
FIG. 2 is a sectional view of the developing device in the First Embodiment.

In this way, the magnetic carrier supplied from the second feeding screw 34 is carried in an erected state on the surface of the developing sleeve 70 together with the toner deposited thereon by the triboelectric charge, and then is fed in an arrow E direction in FIG. 2. Incidentally, in this embodiment, the rotational direction E of the developing sleeve 70 is set so as to be counterdirectional to the rotational direction D of the photosensitive drum 1, but may also be set so as to be the same direction as the rotational direction D of the photosensitive drum 1.

Further, in the case of this embodiment, as members opposing the surface of the developing sleeve 70, in addition to the second feeding screw 34, a developer rectifying portion 35 and a coating amount regulating portion 36 and the photosensitive drum 1 are provided. In this embodiment, the developer rectifying portion 35 and the coating amount regulating portion 36 are integrally formed of a resin material as a non-magnetic material, and constitute a sleeve holder frame 37. The sleeve holder frame 37 is, e.g., formed by molding the resin material. As the resin material for the sleeve holder frame 37, it is possible to use PC (polycarbonate)+AS (acrylonitrile-styrene copolymer), PC+ABS (acrylonitrile-butadiene-styrene copolymer), and the like. Further, a fiber material such as glass or carbon may preferably be incorporated into such a resin material.

Incidentally, as the material for the sleeve holder frame 37, the material is not limited to the resin material but may also be a non-magnetic metal material such as an aluminum alloy. For example, the sleeve holder frame 37 may also be formed by aluminum die-cast. Further, the developer rectifying portion 35 and the coating amount regulating portion 36 may be constituted as separate members and may be connected with each other.

Figure 3:
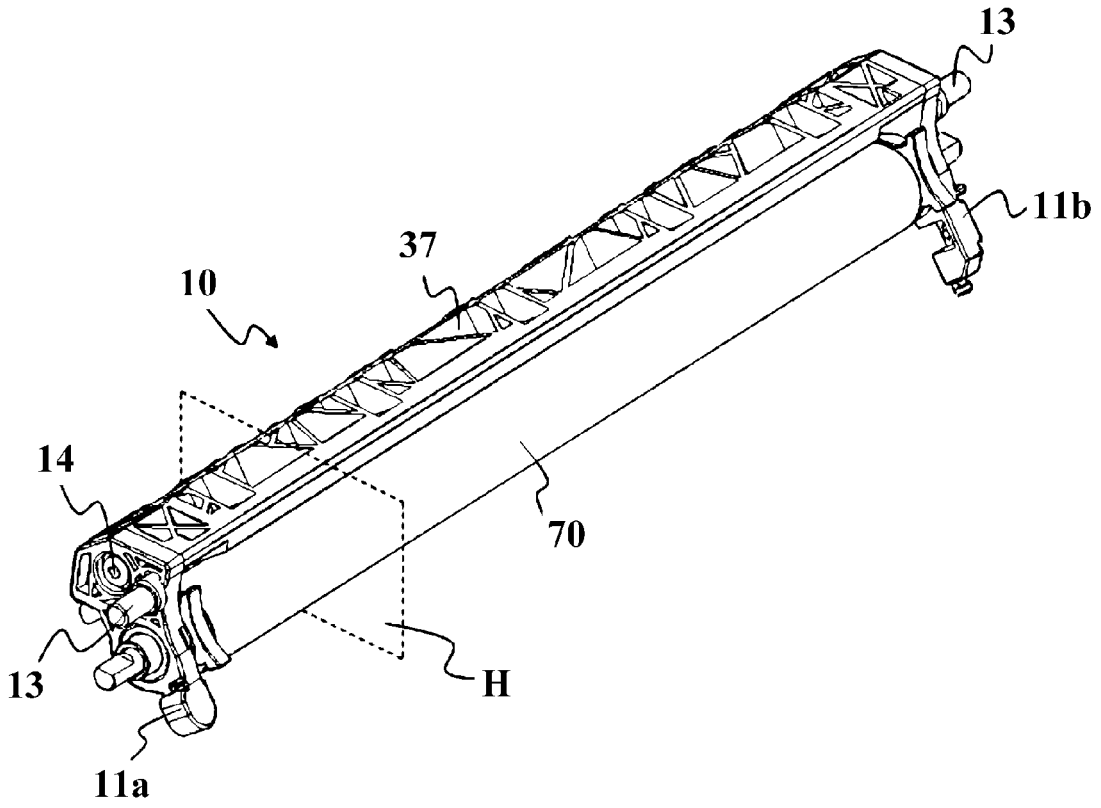
FIG. 3 is a perspective view of the developing device in the First Embodiment.

FIG. 3 shows a supporting structure of the developing sleeve 70 by the sleeve holder frame 37. The sleeve holder frame 37 constitutes a sleeve holder unit 10 together with sleeve bearing members 11*a* and 11*b* provided at end portions thereof. An attitude of the sleeve holder unit 10 is fixed to the developing container 30 by a positioning shaft 13.

[Developer Rectifying Portion and Coating Amount Regulating Portion]

Figure 4:
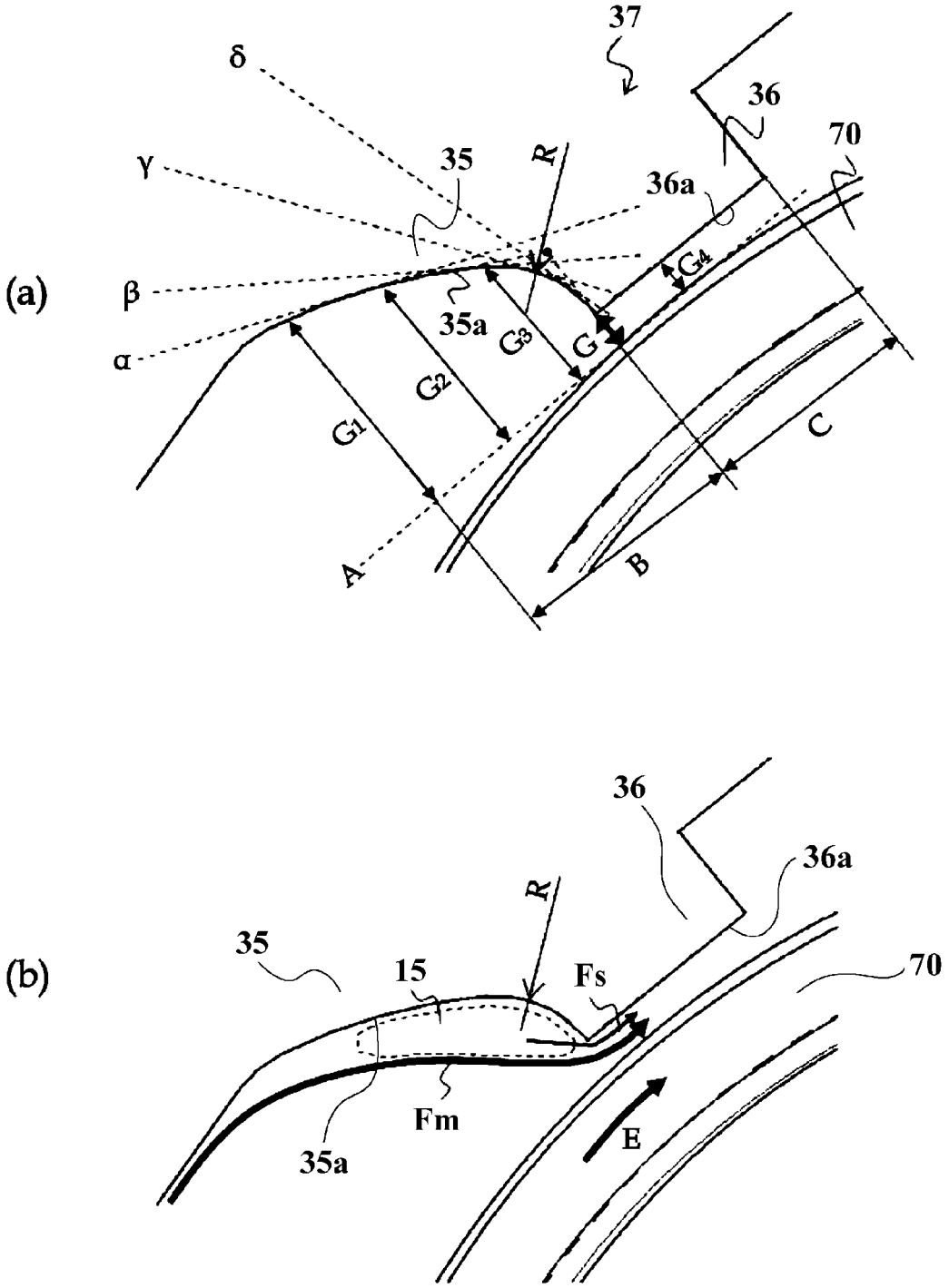
In FIG. 4, (a) is a schematic view showing a relationship between a coating amount regulating surface, a developer rectifying surface and a developing sleeve surface in the First Embodiment, and (b) is a schematic view showing a flow of a developer in the First Embodiment.

Next, the developer rectifying portion 35 and the coating amount regulating portion 36 which are formed on the sleeve holder frame 37 will be described with further reference to FIG. 4. FIG. 4 shows a relationship between the developer rectifying portion 35, the coating amount regulating portion 36 and the developing sleeve 70 in the case where the sleeve holder unit is seen along a cross-section H shown in FIG. 3. The coating amount regulating portion 36 includes a coating amount regulating surface 36*a* opposing the surface of the developing sleeve 70, and regulates a coating amount of the developer carried on the developing sleeve 70. Further, the developer rectifying portion 35 is disposed upstream of the coating amount regulating portion 36 with respect to a developer feeding direction (arrow E direction) of the developing sleeve 70, and has a developer rectifying surface 35*a* continuous to the coating amount regulating surface 36*a* in the developing sleeve 70 side (developer carrying member) side.

In this embodiment, as shown in (a) of FIG. 4, a closest portion between the coating amount regulating portion 36 and the developing sleeve 70 (i.e., a closest position between the surface of the developing sleeve 70 and the coating amount regulating surface 36*a*) is defined at an entrance portion of the coating amount regulating portion 36. That is, at an upstream-most end of the coating amount regulating portion 36 with respect to the developer feeding direction, a gap (spacing) between the coating amount regulating surface 36*a* and the surface of the developing sleeve 70 is smallest. Accordingly, the gap (smallest gap or interval) at this position is referred to as an SB gap G.

Adjustment of the SB gap G in this embodiment is performed by moving a position of the sleeve holder frame 37 relative to the sleeve bearing members 11*a* and 11*b*, and after falling of a value of the SB gap G within a desired range is checked by, e.g., a camera, the sleeve holder frame 37 is fixed (secured) with a screw 14 (FIG. 3).

With respect to the sleeve holder frame 37 disposed in this way, a surface thereof in the developing sleeve 70 side is a flow path wall surface for forming a developer flow path. Accordingly, the developer rectifying surface 35*a* and the coating amount regulating surface 36*a* of the developer rectifying portion 35 and the coating amount regulating portion 36, respectively, constitute a part of the flow path wall surface. Here, a contact flat plane A contacting the developing sleeve 70 at the closest position between the surface of the developing sleeve 70 and the coating amount regulating surface 36*a* is defined.

The developer rectifying surface 35*a* is formed so that a gap thereof with the contact flat plane A decreases toward a downstream side of the developer feeding direction and so that a rate of a change in reduction (a rate of a decrease) of the gap with the contact flat plane A increases toward the downstream side of the developer feeding direction. That is, the developer rectifying surface 35*a* is monotonously decreased in gap with the contact flat plane A. In this embodiment, the developer rectifying surface 35*a* is a smoothly continuous surface obtained by smoothly continuing a plurality of partly cylindrical curved surfaces different in radius of curvature. Here, the smoothly continuous surface refers to a surface where a slope of a tangential line continuously changes, and refers to a surface where the tangential line is substantially formed by a single line at any point of the rectifying surface. Specifically, the radius of curvature of the curved surface decreases toward the downstream side of the developer feeding direction, and the radius of curvature of a downstream-most curved surface with respect to the developer feeding direction is taken as R.

Incidentally, the developer rectifying surface 35*a* may also be constituted by a single curved surface having the above-described radius of curvature A. Further, if line segments are in a range such that the line segments can be substantially regarded as curved lines, the developer rectifying surface 35*a* may also be a surface obtained by smoothly connecting the curved surfaces and minute flat planes (surfaces). Incidentally, "the range such that the line segments can be substantially regarded as curved lines" may preferably be a range in which a single flat surface section is 0.5 mm or less. In a more preferred example, in the range, the single flat surface section is constituted by a rectilinear line of 0.2 mm or less. The radius of curvature of an inscribed circle of these flat surfaces is set at the radius of curvature A described above. Further, in the case where the developer rectifying surface 35*a* is constituted by combining a plurality of curved surfaces with a plurality of flat surfaces, the radius of curvature of the downstreammost curved surface is set at the radius of curvature A described above. In either case, the developer rectifying surface 35*a* may only be required to be formed so that the gap with the contact flat plane A decreases toward the downstream side of the developer feeding direction and so that the reduction change rate of the gap with the contact flat plane A increases toward the reduction change rate of the gap with the contact flat plane.

On the other hand, the coating amount regulating surface 36*a* is formed so that the gap with the contact flat plane A is, in a developer feeding direction downstream side from a position (SB gap) where the gap with the contact flat plane A is smallest, formed so that the gap with the contact flat plane A is constant or increases toward the downstream side of the developer feeding direction. In this embodiment, the coating amount regulating surface 36*a* is formed in parallel to the contact flat plane A, and the gap thereof with the contact flat plane A is made constant with respect to the developer feeding direction.

Further, the developer rectifying surface 35*a* and the coating amount regulating surface 36*a* are formed, so that the downstream end of the developer rectifying surface 35*a* with respect to the developer feeding direction coincides with the upstream end of the portion, of the coating amount regulating surface 36*a* with respect to the developer feeding direction, where the gap with the contact flat plane A is smallest. In other words, at the downstream end of the developer rectifying surface 35*a*, the gap with the contact flat plane A is smallest (minimum).

Figure 12:
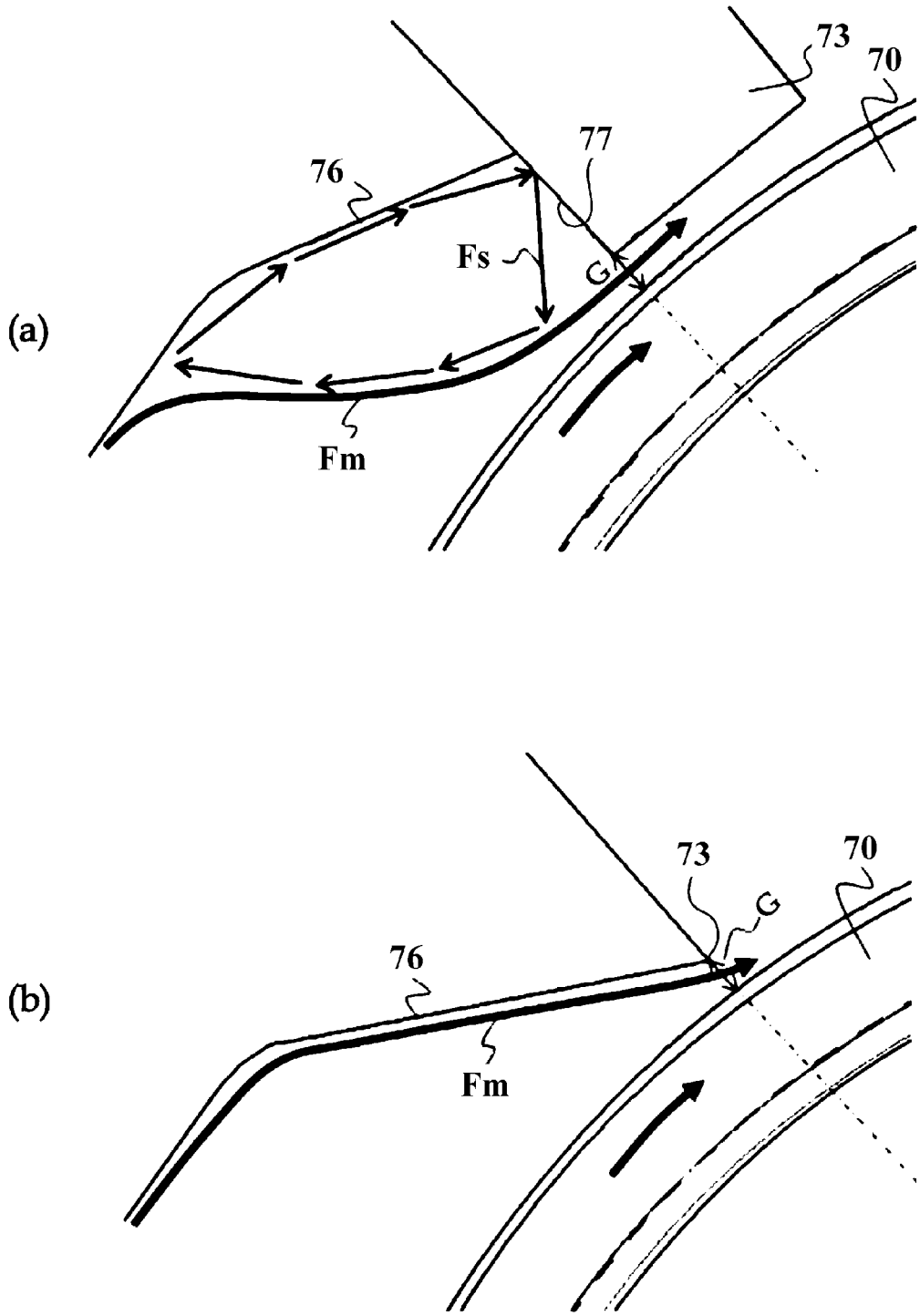
In FIG. 12, (a) and (b) are schematic views showing two examples each showing a seam between a developer station limiting member and a doctor blade and a flow of a developer at that time in order to explain a problem of the present invention.

In other words, the developer rectifying surface 35*a* and the coating amount regulating surface 36*a* which are constituted as described above are, as shown in (a) of FIG. 4, configured so that the gap with the contact flat plane A is changed from the upstream side to the downstream side in the order of G1, G2, G3, (G), and G4. A relationship between these gaps is G1>G2>G3>G4 (=G). A section B shown in (a) of FIG. 4 is a reduction section in which the gap is rapidly reduced and corresponds to the developer rectifying surface 35*a*. A section C continuously downstream of the section B is a constant section in which the gap with the contact flat plane A is not changed from the SB gap G and includes the coating amount regulating surface 36*a*. Incidentally, the coating amount regulating surface 36*a* is set in parallel to the contact flat plane A, but a tolerable slope of the surface (plane) is within a range of about ±2 degrees. In a preferred example, the slope (angle) formed between the coating amount regulating surface 36*a* and the contact flat plane A is within a range of ±1 degree. When the SB gap G is changed, a coating amount per unit area of the developer on the developing sleeve 70 is changed, but in view of a measurement error, a threshold, of a change amount of the SG gap, where the developer coating amount can be discriminated that the coating amount of the developer is clearly changed, i.e., that a flow of the developer is clearly changed corresponds to the slope within the range of ±1 degree with respect to a width of the coating amount regulating portion 36 (i.e., corresponding to a width of the section C; a width of 1.2 mm in this embodiment). When the slope is out of the range of ±1 degree, the coating amount regulating surface 36*a* approaches the developer stagnation limiting member 76 shown in (b) of FIG. 12, and therefore an effect of the present invention cannot be sufficiently obtained.

Here, as tangential lines of the developer rectifying surface 35*a*, α to δ are taken as shown in (a) of FIG. 4, slopes of the tangential lines α to δ increase toward the downstream side of the developer feeding direction. That is, the reduction change rate of the developer rectifying surface 35*a* increases toward the downstream side of the developer feeding direction. A contour shape of the developer rectifying surface 35*a* for defining the reduction change rate will be described. The developer rectifying 35*a* may desirably have a surface roughness Ra of 1.6 mm or less, and when the surface roughness Ra exceeds 1.6 mm, a sidestream Fs supplied from a stagnation layer 15 to the SB gap G shown in (b) of FIG. 4 is liable to become unstable. That is a problem generated by a phenomenon such that the unstable sidestream Fs relates to a toner particle size and when the surface roughness exceeds about ¼ of the toner particle size, the influence of the toner caught by an uneven (projection/recess) surface of the developer rectifying surface 35*a* appears conspicuously, and then the accumulated stagnation layer 15 is abruptly peeled off from the flow path wall surface to flow into the SB gap G.

In the present invention, a principal problem is not a random and periodical density non-uniformity (abruptly generating density fluctuation) resulting from the surface roughness but is sensitivity of the density fluctuation resulting from the sidestream generated by the stepped portion of the developer rectifying surface 35*a*. That is, the contour shape, of the developer rectifying surface 35*a*, which is a characteristic feature of the present invention is defined as a macroscopic contour shape except for at least an uneven component of a level corresponding to the surface roughness described above.

The definition and a measuring method of the contour shape of the developer rectifying surface 35*a* will be specifically described. The developer rectifying surface 35*a* has the contour shape including the curved surface, and therefore is measured by using a shape measuring laser microscope ("VK-X100", manufactured by KEYENCE Corp.) in which there is no constraint of a feeding direction of a stylus or the like. Measured data contains, in the order from a shorter wavelength, a component of the above-described surface roughness, a surface waviness component due to a processing machine, and a fluctuation component within a geometrical tolerance. Accordingly, in order to obtain only the contour shape contributing to the flow of the developer as the problem of the present invention, a wavelength filter for removing these components is used. Finishing of ordinary mechanical processing (machining) is of a level (e.g., flatness) such that the uneven surface falls within a parallel surface of 20-50 μm, and the influence of the sidestream generated by a stepped portion of this level is no problem. That is, in the present invention, a shape of a stepped portion, of the developer rectifying surface 35*a*, exceeding 50 μm is considered as a functionally intended contour shape a maximum value of 50 μm between projections and recesses of the uneven shape is used as a threshold, and a corresponding cutoff value is used. The cutoff value is selected by using a value defined in JIS B 0633 as an index thereof.

The present invention is characterized in that the reduction change rate of the slope of the tangential line increases toward the downstream side of the developer feeding direction in the contour shape of the developer rectifying surface 35*a* from which the unnecessary wavelength components are removed in the above-described manner.

Next, with reference to FIG. 5, a section and a shape of the developer rectifying surface 35*a* for obtaining the effect of this embodiment will be described. First, the section in which the effect as the developer rectifying surface 35*a* in this embodiment is obtained is a section from an entrance portion E of the coating amount regulating portion 36 to a position spaced from the entrance portion E by a distance which is 3 times the SB gap G (i.e., by 3G) toward an upstream side of the developer feeding direction, more preferably be a section from the entrance portion E to a position spaced from the entrance portion E by a distance which is 5 times the SB gap G (i.e., by 5G). Here, the entrance portion E is a point of intersection of the developer rectifying surface 35*a* and a surface (plane) contacting the coating amount regulating surface 36*a* at a position where the gap between the coating amount regulating surface 36*a* and the surface of the developing sleeve 70 is smallest. In this embodiment, the SB gap G is 1300 μm, and therefore a range in which the effect as the developer rectifying surface 35*a* is obtained is about 1.5 mm from the entrance portion E toward the upstream side.

Next, the curved surface shape of the developer rectifying surface 35*a* will be described. As shown in FIG. 5, the entrance portion E is used as an origin, and an X'-axis is taken in a direction parallel to the contact flat plane A and a Y'-axis is taken in a direction perpendicular to the X'-axis. In this case, any one of a square, a rectangle and a trapezoid each of which shape is surrounded (defined) by a range from the origin E to a position spaced from the origin E by a distance which is 5 times the SB gap G (i.e., by 5G) with respect to each of the X'-axis and the Y'-axis is defined. Then, of sides of these shapes, two sides consisting of the side of the Y'-axis and the side connected with the side on the Y'-axis at a vertex, other than the origin E, of the side on the Y'-axis are inscribed by a curved surface, of a circle or an ellipse, by which the curved surface of the developer rectifying surface 35*a* is smoothly formed. Particularly, as the curved surface of the developer rectifying surface 35*a*, a part of a maximum circle or ellipse inscribed in these two sides may be used preferably.

Figure 5:
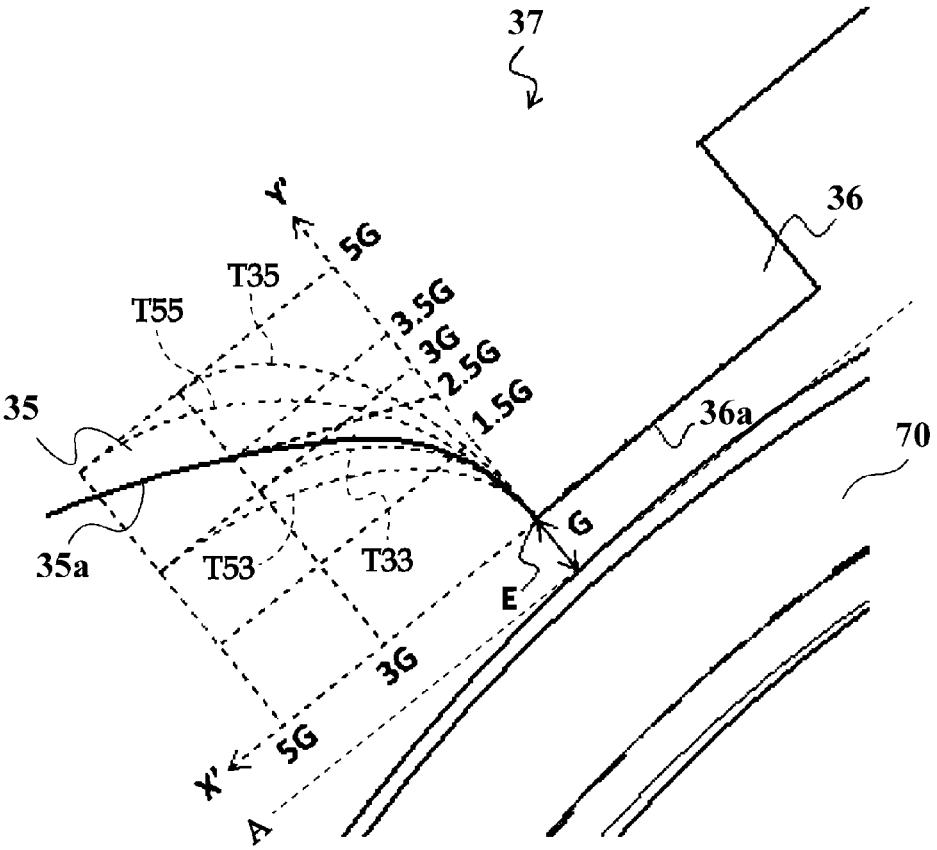
FIG. 5 is a schematic view, similar to FIG. 4, for illustrating sections and a shape of the developer rectifying surface in the First Embodiment.

Each of curved surfaces T35 and T53 shown in FIG. 5 is formed by the part of the maximum ellipse inscribed in the two sides of an associated one of a rectangle defined by 3G×5G (X'-axis×Y'-axis) for T35 and a rectangle defined by 5G×3G (X'-axis×Y'-axis) for T53. Incidentally, 3G is a distance which is 3 times the SB gap G. A more preferred constitution for sufficiently obtaining a rectifying effect in this embodiment, the following condition may preferably be satisfied. That is, the developer rectifying surface 35*a* is formed in a space sandwiched at least between the curved surfaces T35 and T53, and is the curved surface such that the gap with the contact flat plane A is narrowed toward the downstream side of the developer feeding direction and that the shape thereof is convex toward a side where the developer rectifying surface 35*a* is spaced from the developing sleeve 70. As a result, a pocket portion described later can be sufficiently ensured.

For example, the curved surfaces T33 and T55 are parts of maximum circles inscribed in two sides of a square defined by 3G×3G (X'-axis×Y'-axis) and inscribed in two sides of a square defined by 5G×5G (X'-axis×Y'-axis), respectively. However, in the case of the trapezoid, two sides consisting of a large one of the upper and lower sides (bases) and a side corresponding to a height are taken so as to correspond to the distance which is 3 to 5 times the SB gap G (3G to 5G). At this time, a small one of the upper and lower sides is defined so that the distance which is 1.5 times the SB gap (1.5G) is set as a lower limit. Further, in the case of the rectangle (including the square), the length of the short side may preferably be at least 3G.

The developer rectifying surface 35*a* in this embodiment indicated by a solid line in FIG. 5 is an example in which the developer rectifying surface 35*a* is defined by a trapezoidal region. Specifically, X'=3G (0.9 mm when G=300 μm), Y'=3.5 G (1 mm) and Y'=2.5G (0.75 mm) are defined as the height, the lower side and the upper side, respectively. Then, the radius of curvature R (R=1.0) of the developer rectifying surface 35*a* is determined by a maximum arcuate shape inscribed in the side (upper side) on the Y'-axis and a side connecting the vertex (X'=0, Y'=2.5G) of the upper side and the vertex (X'=3G, Y'=3.5G) of the lower side.

The reason why the curved surface shape of the developer rectifying surface 35*a* is defined as the trapezoidal shape in this way is that the following condition is satisfied in a section upstream of the upstream end of the developer rectifying surface 35*a* with respect to the developer feeding direction. That is, the gap between the developer rectifying portion 35 and the surface of the developing sleeve 70 is formed so as to be not less than the gap between the upstream end of the developer rectifying surface 35*a* and the surface of the developing sleeve 70 (FIG. 2). In this embodiment, the upstream end of the developer rectifying surface 35*a* is defined as a position where a plane parallel to the Y'-axis passing through X'=5G and the developer rectifying surface 35*a* intersect with each other in FIG. 5.

That is, when the gap at this portion is smaller than the gap between the developer rectifying surface 35*a* and the developing sleeve 70, the flow of the developer carried and fed by the developing sleeve 70 is obstructed. For this reason, the section upstream of the developer rectifying surface 35*a* is set appropriately so as to be broad in consideration of the flow of the developer in the developing device. In the case of this embodiment, from the viewpoint that the curved surface smoothly connected with a locus from the upstream section of the developer surface 35*a* is connected, it is optimum that the above-described trapezoid is defined. However, in some cases, it is optimum that the square region or the rectangular region is defined depending on the locus from the upstream section.

In summary, in this embodiment, as the section in which the rectifying effect of the developer rectifying surface 35*a* is obtained, the section of X'=3G (and corresponding Y'=3.5G) is defined. Further, as the pocket portion for properly obtaining the stagnation layer ((b) of FIG. 4) of the developer described later, a depth Y'=2.5G is ensured. Incidentally, in the above description, the small one of the upper and lower sides of the trapezoid has 1.5G as the lower limit, but this means that there is a need to provide the depth which is about 1.5 times the SB gap G at lowest as the pocket portion for obtaining the stagnation. In this embodiment, the depth which is about 2.5 times the SB gap G was an optimum value.

[Flow of Developer]

Next, with reference to (b) of FIG. 4, the flow of the developer between the developer rectifying surface 35*a*, the coating amount regulating surface 36*a* and the developing sleeve 70 in this embodiment will be described. With respect to a mainstream carried and fed by the magnetic force of the developing sleeve 70 (flow in a region toward the developing sleeve with a boundary indicated by an arrow Fm, hereinafter simply referred to as a mainstream Fm), the developer rectifying surface 35*a* (reduction section B) has a flow path shape including an upwardly convexly curved surface (concavely curved surface with respect to the rectifying surface) in the figure. This mainstream Fm passes through this flow path shape toward the SB gap, and therefore thickness regulation of the developer coating amount at the coating amount regulating surface 36*a* is performed while suppressing generation of a sidestream component (repelling component) such that it pushes back the mainstream Fm. For this reason, the developer scraped off in the SB gap G forms the stagnation layer 15, but turbulence of the mainstream Fm by the repelling component is very small. As a result, a part of the stagnation layer 15 located in the neighborhood of the boundary with the mainstream Fm is caught up in the mainstream Fm, so that the sidestream Fs flowing into the SB gap G is formed.

Effect of this Embodiment

In the case of this embodiment, as described above, the developer rectifying surface 35*a* continuous to the coating amount regulating surface 36*a* is formed so that the gap with the contact flat plane A decreases toward the downstream side of the developer feeding direction and so that the reduction change rate of the gap with the contact flat plane A increases toward the downstream side of the developer feeding direction. For this reason, as described above, the sidestream component such that it pushes back the mainstream Fm of the developer fed by the developing sleeve 70 is reduced, so that instability of the developer coating amount by the influence of the sidestream is suppressed.

Further, the developer rectifying surface 35*a* constitutes the pocket shape (concavely curved surface) for forming the stagnation layer 15 in the upstream side of the coating amount regulating portion 36. For this reason, the sidestream Fs such that the developer is supplied from the stagnation layer 15 toward the gap (SB gap) between the coating amount regulating portion 36 and the developing sleeve 70 is formed, so that sensitivity of a change in developer coating amount with respect to a change in gap is suppressed. In other words, the stagnation layer 15 constitutes a buffer of the developer to be supplied to the SB gap to absorb the change in coating amount caused due to an error of the SB gap. As a result, irrespective of the error of the SB gap, the sidestream component such that the developer is stably supplied toward the SB gap is formed, so that a flow rate (amount) of the developer passing through the SB gap is stabilized. Further, with respect to a developer coating performance, a robust property against disturbances such as variations of parts and an adjusting operation and an environmental fluctuation is improved. That is, there is no need to strictly regulate the SB gap, and therefore a stable development density is obtained without requiring high part accuracy and high adjustment accuracy.

Further, in the present invention, the rectifying surface 35*a* has the X-axis component of 3G or less and is formed smoothly in all of the sections upstream of the origin E. For this reason, it is possible to suppress disorder, in the neighborhood of the origin, of the above-described rectifying effect for stabilizing the coating amount, so that an effect of stabilizing the amount of the developer to be supplied to the developing sleeve can be obtained.

Incidentally, in this embodiment, an example in which the entire region of the rectifying surface is smoothly formed is described, but the smoothly formed region may also be only a region (within 3G in each coordination system) in the neighborhood of the origin largely contributing to the coating amount stability. In a region upstream of the neighborhood of the origin, e.g., a shape connecting minute rectilinear lines with each other may also be formed.

Figure 6:
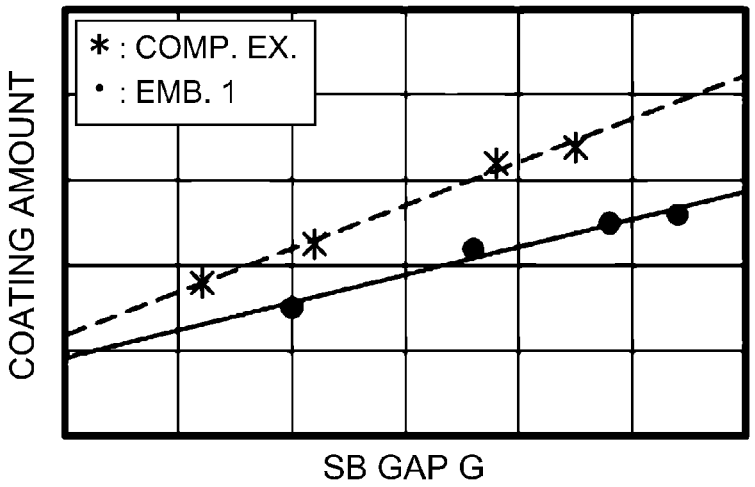
FIG. 6 is a graph showing a change in coating amount of the developer with respect to a change in SB gap in the First Embodiment ("EMB.1") and a Comparison Example ("COMP.EX.").

Next, an experiment conducted for checking the effect of this embodiment will be described. In this experiment, the change in coating amount of the developer on the developing sleeve with respect to the change in SB gap G was checked in the constitution of this embodiment ("EMB.1") and the above-described constitution shown in (a) of FIG. 12 ("COMP.EX."). A result is shown in FIG. 6. In FIG. 6, the abscissa represents a magnitude of the SB gap G, and the ordinate represents a weight of the developer coated on the developing sleeve 70 per unit area. A graph indicated by a broken line shows data in Comparison Example ("COMP. EX.") shown in (a) of FIG. 12, and a graph indicated by a solid line shows data of this embodiment (First Embodiment ("EMB. 1") shown in FIG. 4.

As is apparent from FIG. 6, it is understood that the sensitivity of the coating amount change with respect to the SB gap G in the constitution in the First Embodiment is duller than the sensitivity in the Comparison Example. This is an effect obtained by stabilization of the flow rate (amount) of the developer passing through the SB gap G by the mainstream Fm and the sidestream Fs shown in (b) of FIG. 4. Accordingly, according to this embodiment, e.g., even when a simple and inexpensive constitution in which the part accuracy and the adjustment accuracy of the sleeve holder frame 37 are alleviated is employed, it is possible to less cause the fluctuation in development density.

Incidentally, in this embodiment, the sleeve holder frame 37 is molded with the resin material such as PC+ABS, so that a high degree of freedom of design and machining is realized with respect to the continuous shape of the developer rectifying surface 35*a* and the coating amount regulating surface 36*a*. Further, by integrally constituting the developer rectifying portion 35 and the coating amount regulating portion 36 by the resin material, the sleeve holder frame 37 is capable of ensuring sufficiently large geometrical moment of inertia also against warpage and flexure required for the layer thickness regulation.

Figure 7:
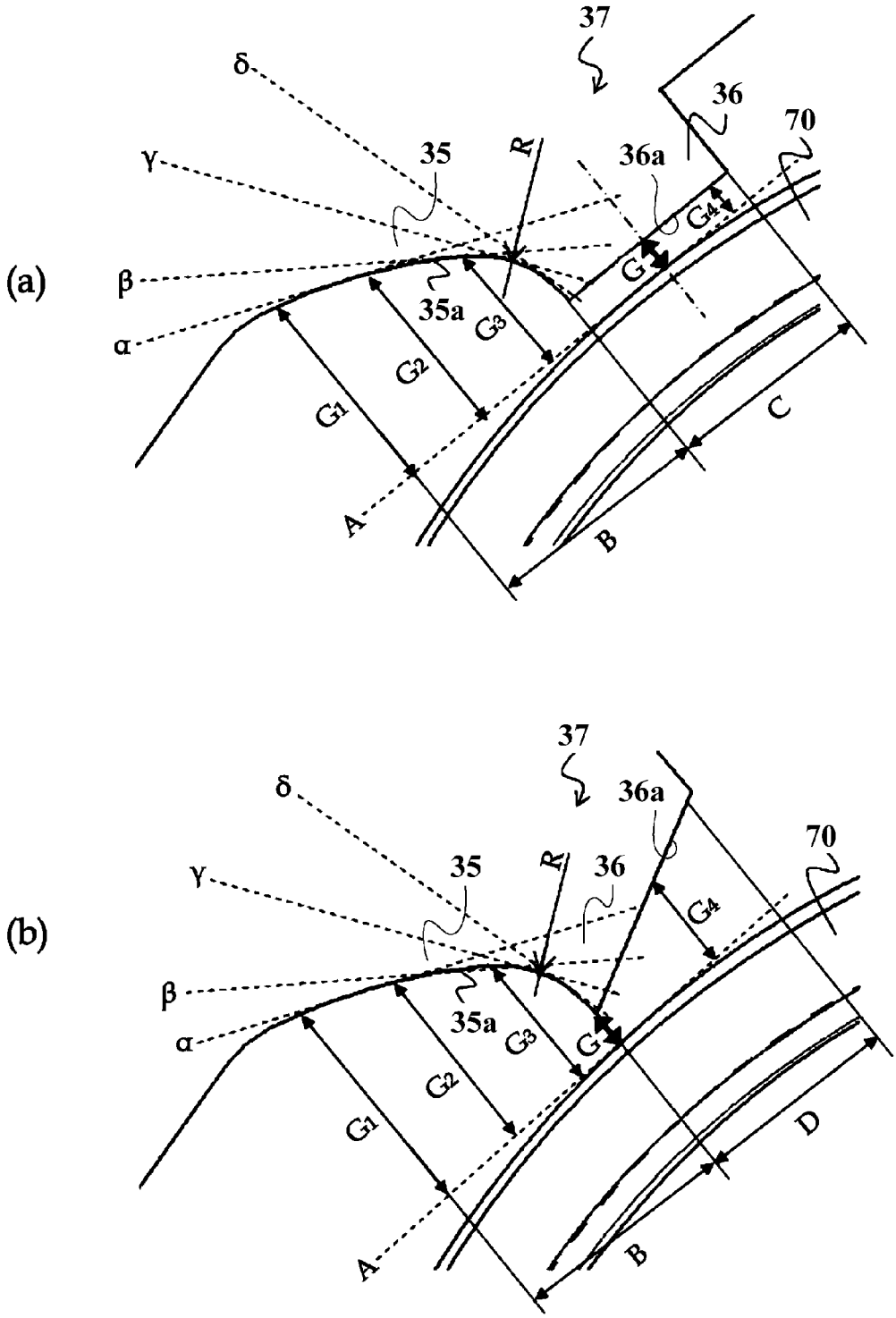
In FIG. 7, (a) and (b) are schematic views showing two other examples, in the First Embodiment, in which a relationship between the coating amount regulating surface, the developer rectifying surface and the developing sleeve surface is shown.

Next, with reference to FIG. 7, also derivative examples of this embodiment will be described. In FIG. 7, (a) shows the case where the SB gap G is defined by the coating amount regulating surface 36*a* (flat surface) of the coating amount regulating portion 36. That is the example shown in (a) of FIG. 7 is an instance in which a central portion of the flat surface is the closest portion between the coating amount regulating surface 36*a* and the developing sleeve 70. Also in this case, the flow path shape can be constituted similarly as in the constitution shown in (a) of FIG. 4. That is, the contact flat plane A of the developing sleeve 70 at the closest portion (SB gap G) is defined. In this case, it is possible to define the reduction section B in which the gap between the contact flat plane A and the developer flow path wall surface is reduced, that the gap at an end point of the reduction section B is equal to the SB gap G, and the constant section C in which the gap is not changed in a region downstream of the section B.

In FIG. 7, (b) shows the case where the coating amount regulating portion 36 is locally provided (a constitution in which a corner edge portion is provided at a closest position to the surface of the developing sleeve). Similarly, when the contact flat plane A is defined at the closest portion, such a point that the coating amount regulating surface 36*a* can be defined as an enlargement section D in which the gap with the contact flat plane A is enlarged toward the downstream side of the developer feeding direction is different from the above-described example. However, even in such a constitution, it is understood that a portion leading to the enlargement section D can be formed in the flow path shape capable of obtaining the same effect. That is, also in other SB gap constitutions as shown in (a) and (b) of FIG. 7, it is possible to obtain the effect of the developer flow path in this embodiment.

Second Embodiment

The Second Embodiment of the present invention will be described with reference to FIGS. 8 to 10. In this embodiment, a guiding portion (round edge portion) 35*b* is provided at a portion continuous to the developer rectifying surface 35*a* in the upstream side of the developer rectifying surface 35*a*. Other points are the same as those in the First Embodiment described above, and therefore a point of a difference from the First Embodiment will be principally described. In this embodiment, a rectifying portion 35 for rectifying the developer located in the upstream side of the regulating portion 36 is formed by the rectifying surface 35*a* and the guiding portion 35*b*.

The guiding portion 35*b* is provided so as to smoothly continue between the downstream end of the developer rectifying surface 35*a* with respect to the developer feeding direction and the upstream end of a flat portion 36*c*, with respect to the developer feeding direction, as a portion where the gap between the coating amount regulating surface 36*a* and the contact flat plane A is smallest. Such a guiding portion 35*b* is formed so that the gap with the contact flat plane A decreases toward the downstream side of the developer feeding direction and so that the reduction change rate of the gap with the contact flat plane A decreases toward the downstream side of the developer feeding direction. Further, the flat portion 36*c* is a plane in which the gap with the contact flat plane A is constant with respect to the developer feeding direction.

In this embodiment, the guiding portion 35*b* is constituted by a curved surface (which may include a flat surface) smoothly continuous to the developer rectifying surface 35*a* and a single curved surface, having a radius of curvature R', smoothly continuous to the curved surface, and this single curved surface is smoothly continued to the flat portion 36*c* of the coating amount regulating portion 36. Incidentally, the single curved surface portion of the guiding portion 35*b* may also be a combination of a plurality of curved surfaces and flat surfaces and a single flat surface. In summary, the guiding portion 35*b* may only be required to be formed so that the gap with the contact flat plane A decreases toward the downstream side with respect to the developer feeding direction and the reduction change rate of the gap with the contact flat plane A decreases toward the downstream side with respect to the developer feeding direction. Incidentally, the developer rectifying surface 35*a* and the guiding portion 35*b* may desirably have the surface roughness Ra of 1.6 μm or less similarly as in the First Embodiment. Further, with respect to the reduction change rate for the developer rectifying surface 35*a* and the guiding portion 35*b*, similarly as in the First Embodiment, a maximum value of 50 μm of a difference between projections and recesses of the uneven shape is used as a threshold, and the reduction change rate is defined by a contour shape, of the developer rectifying surface 35*a* and the guiding portion 35*b*, from which wavelength components of a corresponding cut-off value or less are removed. In the following, specific description thereof will be made.

Figure 8:
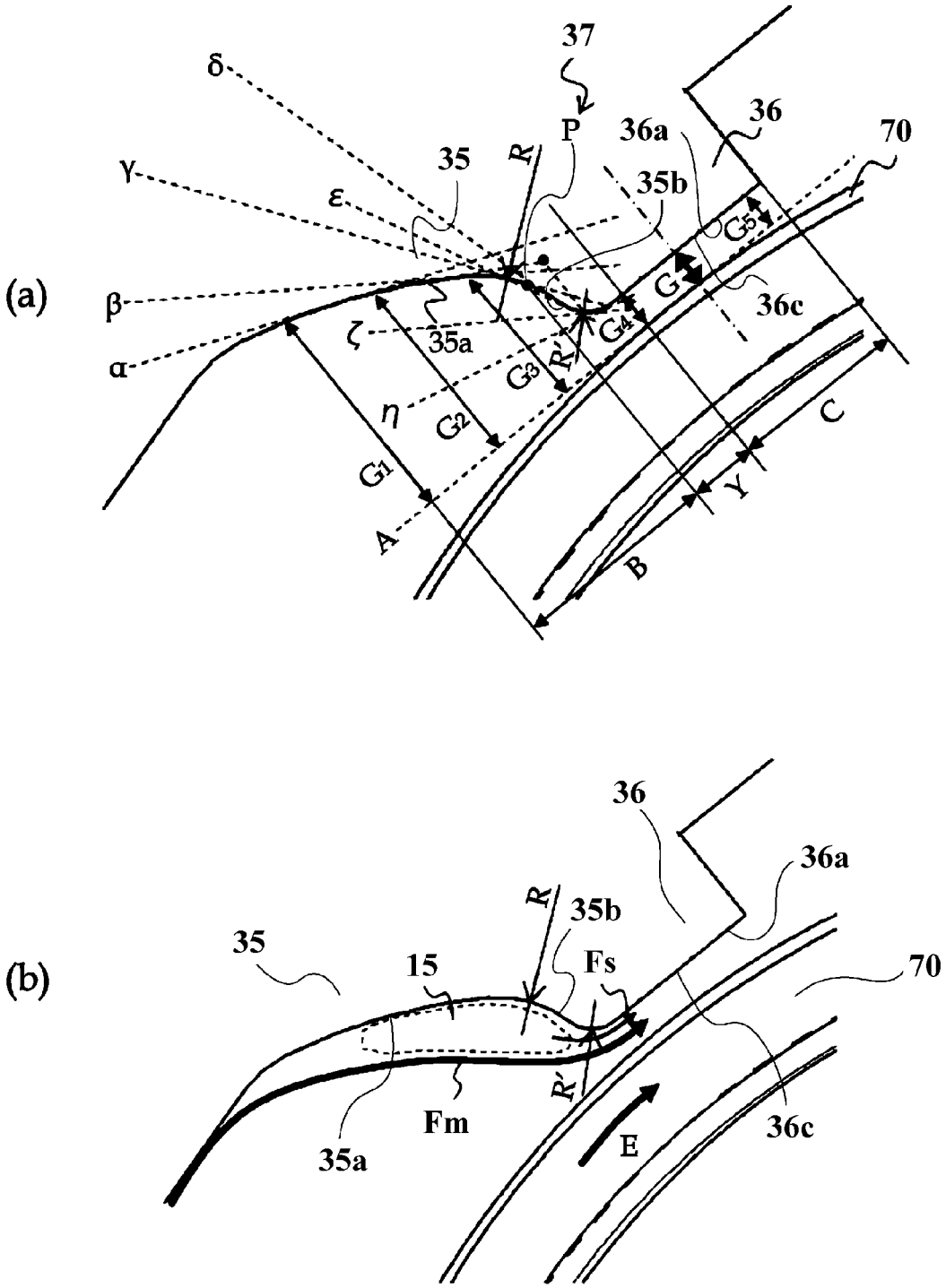
In FIG. 8, (a) is a schematic view showing a relationship between a coating amount regulating surface, a developer rectifying surface and a developing sleeve surface in a Second Embodiment, and (b) is schematic view showing a flow of a developer in the Second Embodiment.

FIG. 8 shows a flow path wall surface of the developer in this embodiment, and shows the cross-section H in FIG. 3 similarly as in FIG. 4. The developer rectifying portion 35 and the coating amount regulating portion 36 which constitute the sleeve holder frame 37 constitute the flow path wall surface for forming a developer flow path between the opposing developing sleeve 70 and these portions.

In this embodiment, as shown in (a) of FIG. 8 at the entrance portion of the coating amount regulating portion 36, the guiding portion 35*b* including the curved surface having the radius of curvature R' is provided. Further, the closest portion between the coating amount regulating portion 36 and the developing sleeve 70, i.e., the SB gap G is defined at a position downstream of an end point of the guiding portion 35*b*. Accordingly, in the case where the contact flat plane A of the developing sleeve 70 at the closest portion (SB gap G) is defined, the gap between the contact flat plane A and the developer flow path is changed from the upstream side to the downstream side in the order of G1, G2, G3, (G), G4, and G5. A relationship between these gaps is G1>G2>G3>G4 (=G=G5).

Further, a section B shown in (a) of FIG. 8 is a reduction section in which the gap is reduced so as to increase the reduction change rate and corresponds to the developer rectifying surface 35*a*. Further, a section Y continuously downstream of the section B is a reduction section in which the gap is decreased so as to decrease the reduction change rate and corresponds to the guiding portion 35*b*. A section C continuously downstream of the section Y is a constant section in which the gap with the contact flat plane A is not changed from the SB gap G and includes the coating amount regulating surface 36*a*. Incidentally, the coating amount regulating surface 36*a* is set in parallel to the contact flat plane A, but a tolerable slope of the surface (plane) is, similarly as in the First Embodiment, within a range of ±2 degrees, preferably within a range of ±1 degree.

Here, as tangential lines of the developer rectifying surface 35*a* and the guiding portion 35*b*, α and η are taken as shown in (a) of FIG. 8, slopes of the tangential lines α to η increase toward the downstream side of the developer feeding direction, and after an inflection point P, the tangential lines ϵ and ρ decrease toward the downstream side of the developer feeding direction. In this way, in this embodiment, the reduction change rate of the developer, flow path is changed from an increasing direction to a decreasing direction.

Next, with reference to FIG. 9, a section and a shape of the developer rectifying surface 35*a* and the shape of the guiding portion 35*b* which are used for obtaining the effect of this embodiment will be described. First, the section in which the effect as the developer rectifying surface 35*a* in this embodiment is obtained is a section from an entrance portion E of the coating amount regulating portion 36 to a position spaced from the entrance portion E by a distance which is 5 times the SB gap G (i.e., by 5G) toward an upstream side of the developer feeding direction. Here, the entrance portion E is a point of intersection of a contact flat plane which passes through the inflection point P and which contacts the developer rectifying surface 35*a*, and a surface (plane) contacting the coating amount regulating surface 36*a* at a position where the gap between the coating amount regulating surface 36*a* and the surface of the developing sleeve 70 is smallest. In this embodiment, the SB gap G is i300 μm, and therefore a range in which the effect as the developer rectifying surface 35*a* is obtained is about 1.5 mm from the entrance portion E toward the upstream side.

Next, the curved surface shape of the developer rectifying surface 35*a* will be described. As shown in FIG. 9, the entrance portion E is used as an origin, and an X'-axis is taken in a direction parallel to the contact flat plane A. Further, a Y'-axis is taken in a direction perpendicular to the X'-axis. In this case, any one of a square, a rectangle and a trapezoid each of which shape is surrounded (defined) by a range from the origin E to a position spaced from the origin E by a distance which is 5 times the SB gap G (i.e., by 5G) with respect to each of the X'-axis and the Y'-axis is defined. Then, of sides of these shapes, two sides consisting of the side of the Y'-axis and the side connected with the side on the Y'-axis at a vertex, other than the origin E, of the side on the Y'-axis are inscribed by a curved surface, of a circle or an ellipse, by which the curved surface of the developer rectifying surface 35*a* is smoothly formed. Particularly, as the curved surface of the developer rectifying surface 35*a*, a part of a maximum circle or ellipse inscribed in these two sides may be used preferably.

Figure 9:
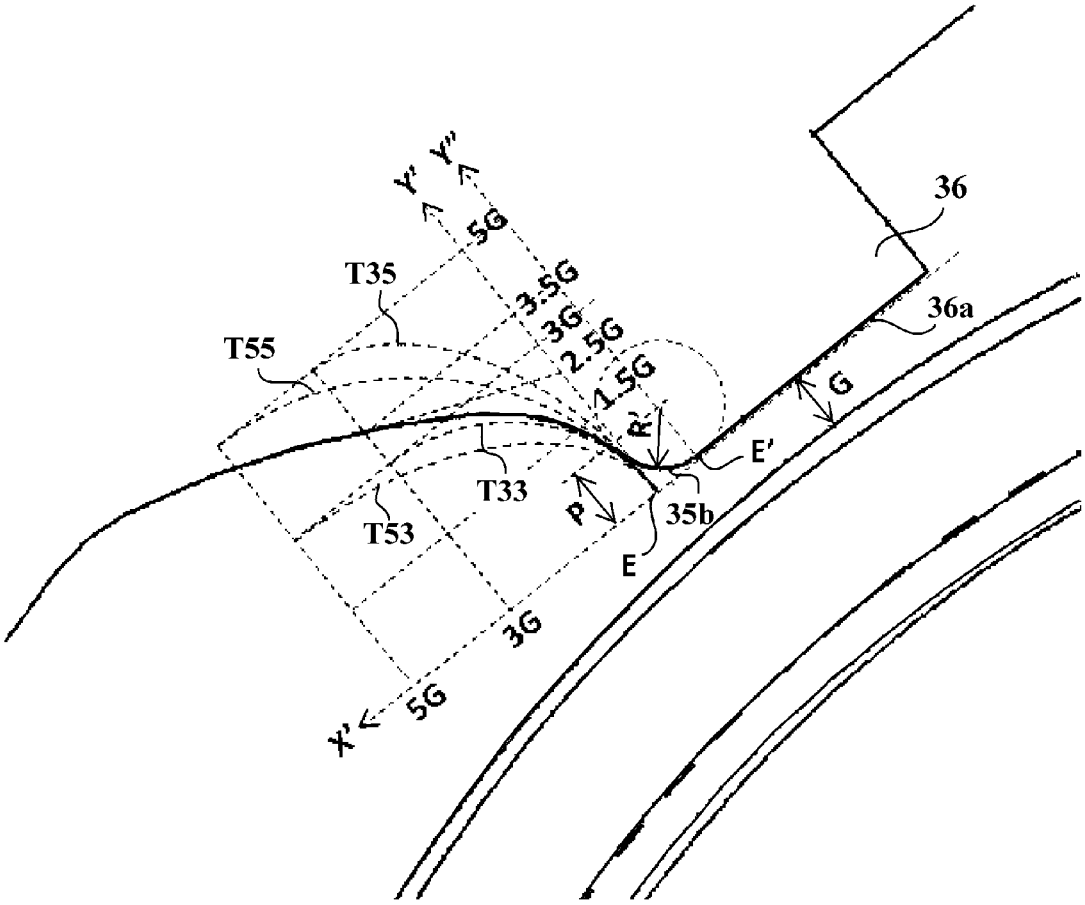
FIG. 9 is a schematic view, similar to FIG. 8, for illustrating sections and a shape of the developer rectifying surface in the Second Embodiment.

Here, each of curved surfaces T35 and T53 shown in FIG. 9 is formed by the part of the maximum ellipse inscribed in the two sides of an associated one of a rectangle defined by 3G×5G (X'-axis×Y'-axis) for T35 and a rectangle defined by 5G×3G (X'-axis×Y'-axis) for T53. A more preferred constitution for sufficiently obtaining a rectifying effect in this embodiment, the following condition may preferably be satisfied. That is, the developer rectifying surface 35*a* is formed in a space sandwiched at least between the curved surfaces T35 and T53, and is the curved surface such that the gap with the contact flat plane A is narrowed toward the downstream side of the developer feeding direction and that the shape thereof is convex toward a side where the developer rectifying surface 35*a* is spaced from the developing sleeve 70. As a result, the pocket portion can be sufficiently ensured similarly as in the First Embodiment.

For example, the curved surfaces T33 and T55 are parts of maximum circles inscribed in two sides of a square defined by 3G×3G (X'-axis×Y'-axis) and inscribed in two sides of a square defined by 5G×5G (X'-axis×Y'-axis), respectively. However, in the case of the trapezoid, two sides consisting of a large one of the upper and lower sides (bases) and a side corresponding to a height are taken so as to correspond to the distance which is 3 to 5 times the SB gap G (3G to 5G). At this time, a small one of the upper and lower sides is defined so that the distance which is 1.5 times the SB gap (1.5G) is set as a lower limit. Further, in the case of the rectangle (including the square), the length of the short side may preferably be at least 3G.

The developer rectifying surface 35*a* in this embodiment indicated by a solid line in FIG. 9 is an example in which the developer rectifying surface 35*a* is defined by a trapezoidal region. Specifically, X'=3G (0.9 mm when G=300 μm), Y'=3.5 G (1 mm) and Y'=2.5G (0.75 mm) are defined as the height, the lower side and the upper side, respectively. Then, the radius of curvature R (R=1.0) of the developer rectifying surface 35*a* is determined by a maximum arcuate shape inscribed in the side (upper side) on the Y'-axis and a side connecting the vertex (X'=0, Y'=2.5G) of the upper side and the vertex (X'=3G, Y'=3.5G) of the lower side.

The reason why the curved surface shape of the developer rectifying surface 35*a* is defined as the trapezoidal shape in this way is that the following condition is satisfied in a section upstream of the upstream end of the developer rectifying surface 35*a* with respect to the developer feeding direction. That is, the gap between the developer rectifying portion 35 and the surface of the developing sleeve 70 is formed so as to be not less than the gap between the upstream end of the developer rectifying surface 35*a* and the surface of the developing sleeve 70 (FIG. 2). In this embodiment, the upstream end of the developer rectifying surface 35*a* refers to a position where a plane parallel to the Y'-axis passing through X'=5G and the developer rectifying surface 35*a* intersect with each other in FIG. 9.

That is, when the gap at this portion is smaller than the gap between the developer rectifying surface 35*a* and the developing sleeve 70, the flow of the developer carried and fed by the developing sleeve 70 is obstructed. For this reason, the section upstream of the developer rectifying surface 35*a* is set appropriately so as to be broad in consideration of the flow of the developer in the developing device. In the case of this embodiment, from the viewpoint that the curved surface smoothly connected with a locus from the upstream section of the developer surface 35*a* is connected, it is optimum that the above-described trapezoid is defined. However, in some cases, it is optimum that the square region or the rectangular region is defined depending on the locus from the upstream section.

Next, tolerable shape and shape range of the guiding portion 35*b* for obtaining the rectifying effect in this embodiment will be described. Here, the origin is taken as an origin E' shown in FIG. 9, and description will be made by using a coordination system X'-Y'. Incidentally, the origin E' is an upstreammost position of the flat surface portion 36*c* of the coating amount regulating surface 36*a*.

A distance from the origin E' to a point smoothly connecting a curved surface for forming the guiding portion 35*b* with the developer rectifying surface 35*a* is P (corresponding to the inflection point P) with respect to a Y"-axis direction. In this embodiment, the distance P may preferably be 1.5G at the maximum with respect to an X'-axis direction. That is, the distance P may preferably be 50% (of 3G) at the maximum within the region of 3G. Conversely, with respect to the X'-axis direction, within the region of 3G, a region of the developer rectifying surface 35*a* (concavely curved surface) as the reduction section B may preferably be formed in an amount of 50% or more (at least 50%). In a more preferable example, with respect to the X'-axis direction, within the region of 5G, the region of the developer rectifying surface 35*a* (concavely curved surface) as the reduction section B is formed in an amount of 70% or more.

Further, the distance P may preferably be 1.5G at the maximum with respect to the Y"-axis direction. That is, the distance P may preferably be 50% (of 3G) at the maximum within the region of 3G. Conversely, with respect to the Y"-axis direction, within the region of 3G, a region of the developer rectifying surface 35*a* (concavely curved surface) as the reduction section B may preferably be formed in an amount of 50% or more (at least 50%). In a more preferable example, with respect to the Y"-axis direction, within the region of 5G, the region of the developer rectifying surface 35*a* (concavely curved surface) as the reduction section B is formed in an amount of 70% or more.

In this embodiment shown in FIG. 9, the distance P from the origin E' to the inflection point is set at a value corresponding to about 27% (about 1.35G) of a maximum value of 5G of the Y"-axis. Further, in this embodiment, the guiding portion 35*b* is formed by an arcuate portion of a circle R' (radius of curvature R' (=0.4 in this embodiment)) which passes through the inflection point P and which contacts the developer rectifying surface 35*a* and the X'-axis. At least in a lower side (toward the developing sleeve 70 side) than the arcuate portion having the radius of curvature R', when the guiding portion 35*b* is formed in an upper side (toward an opposite side to the developing sleeve 70 side) than the X'-axis, it is possible to obtain the effect of this embodiment.

In summary, in this embodiment, the section in which the rectifying effect of the developer rectifying surface 35*a* is obtained is, when the point E' is the origin, within a square formed by a distance 5G with respect to each of the X'-axis and Y'-axis. Further, a range in which the guiding portion 35*b* is formed is within a square region formed by a region ranging from the origin E' to a distance of at most 5G×30%=1.5G with respect to the positive direction of each of the X'-axis and the Y'-axis. That is, as an index of the pocket portion for properly obtaining the developer stagnation layer ((b) of FIG. 8) described later, the inflection point P is located at a position of 30% or less of each of X'=5G and Y"=5G. Conversely, in a region of 70% or more (at least 70%) from each of X'=5G and Y"=5G toward the origin E', there is a need to form the above-described region in which the reduction change rate increases toward the downstream side of the developer feeding direction. In this way, in this embodiment, the guiding portion 35*b* is smoothly formed by the curved surface having the radius of curvature R' from a downstream section of the inflection point P of the developer rectifying surface 35*a*, so that supply of the developer from the stagnation layer to the coating amount regulating portion 36 can be more stabilized.

Further, in this embodiment, all the portions leading to the SB gap G are continuously connected by the curved surface so that the curved surface has a most desirable shape, i.e., the flow path wall surface is smoothest, but when the section thereof is a short section, the curved surface may also partly include a flat surface portion. The rectifying surface 35*a* may also be formed to the extent that rectilinear lines each of 0.5 mm or less are smoothly connected, and the guiding portion 35*b* may also be formed to the extent that rectilinear lines each of 0.2 mm or less are smoothly connected. For example, in sections of R=1 mm and R'=0.4 mm, the curved surface may also be formed to the extent that the rectilinear lines each of 0.2 mm or less are smoothly connected. However, even in this case, also when arcuate portions inscribed in each of the rectilinear sections is drawn, with respect to the radius of curvature R and the radius of curvature R' of the arcuate portions, it is desirable that they substantially coincide with those defined above.

Next, with reference to (b) of FIG. 8, the flow of the developer in the case where the developer flow path in this embodiment is applied will be described. The effect by the developer rectifying surface 35*a* is the same as that in the First Embodiment, with respect to the mainstream Fm carried and fed by the magnetic force of the developing sleeve 70. This mainstream Fm passes through this flow path shape toward the SB gap, and therefore thickness regulation of the developer coating amount is performed while suppressing generation of a sidestream component (repelling component) such that it pushes back the mainstream Fm. For this reason, the developer scraped off in the upstream side of the coating amount regulating portion 36 forms the stagnation layer 15, but turbulence of the mainstream Fm by the repelling component is very small. As a result, a part of the stagnation layer 15 located in the neighborhood of the boundary with the mainstream Fm is caught up in the mainstream Fm, so that the sidestream Fs flowing into the SB gap G is formed. In this embodiment, an effect such that a flowing-in property of the sidestream Fs is stabilized can be obtained by the presence of the guiding portion 35*b*.

In this way, in this embodiment, effects obtained by this embodiment are, in addition to the effect (described with reference to FIG. 6) obtained in the First Embodiment, an effect of improving stability by the guiding portion 35*b*. An experiment conducted for checking the effect of this embodiment will be described. In this experiment, the change in coating amount of the developer on the developing sleeve with respect to the radius of curvature R' of the guiding portion 35*b* provided upstream of the coating amount regulating surface 36*a* was checked in the constitution of this embodiment ("EMB. 2") described with reference to FIGS. 8 and 9 and the above-described constitution shown in (a) of FIG. 12 ("COMP. EX."). A result is shown in (a) of FIG. 10. In (a) of FIG. 10, the abscissa represents a magnitude of the radius of curvature R' ("CURVE R' "), and the ordinate represents a weight of the developer coated on the developing sleeve 70 per unit area. A graph indicated by a broken line shows data in Comparison Example ("COMP.EX.") (in which the radius of curvature R of the developer rectifying surface 35*a* is 0 mm) shown in (a) of FIG. 12, and a graph indicated by a solid line shows data of this embodiment (Second Embodiment ("EMB.2") in which the radius of curvature R of the developer rectifying surface 35*a* is set at 1 mm. That is, in the developer flow paths set by a downstream most curved surfaces, of the developer rectifying surfaces 35*a*, having the radius of curvature R=0 mm and the radius of curvature R=1 mm, respectively, the coating amount was measured by changing, as a parameter, only the radius of curvature R' of the guiding portion 35*b*.

Figure 10:
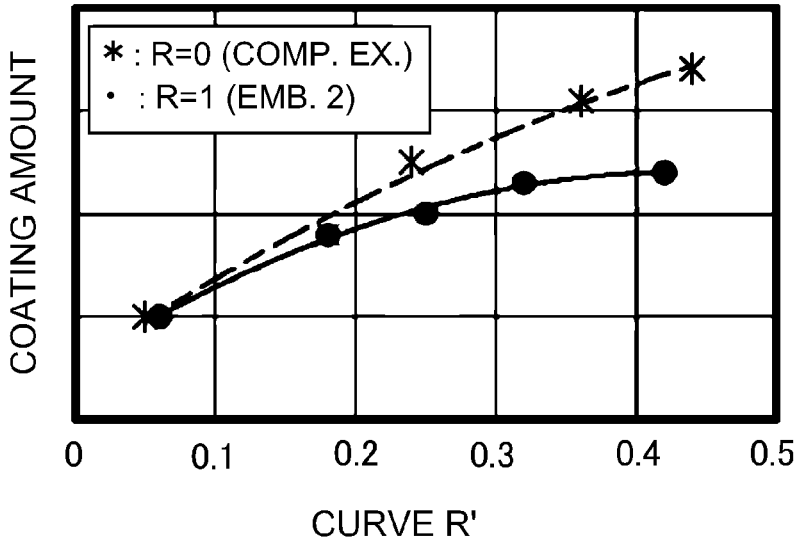
In FIG. 10, (a) is a graph showing a relationship between a radius of curvature and a developer coating amount at a guiding portion in the Second Embodiment ("EMB. 2") and a Comparison Example ("COMP. EX."), and (b) is a graph showing a difference (environmental difference) in coating amount under each of conditions between a low temperature and low humidity environment and a high temperature and high humidity environment.
Figure 10:
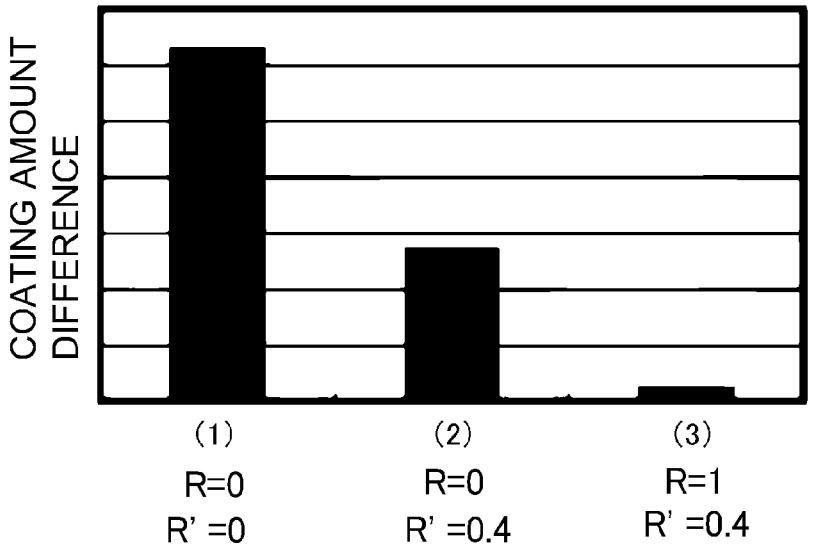
Figure 11:
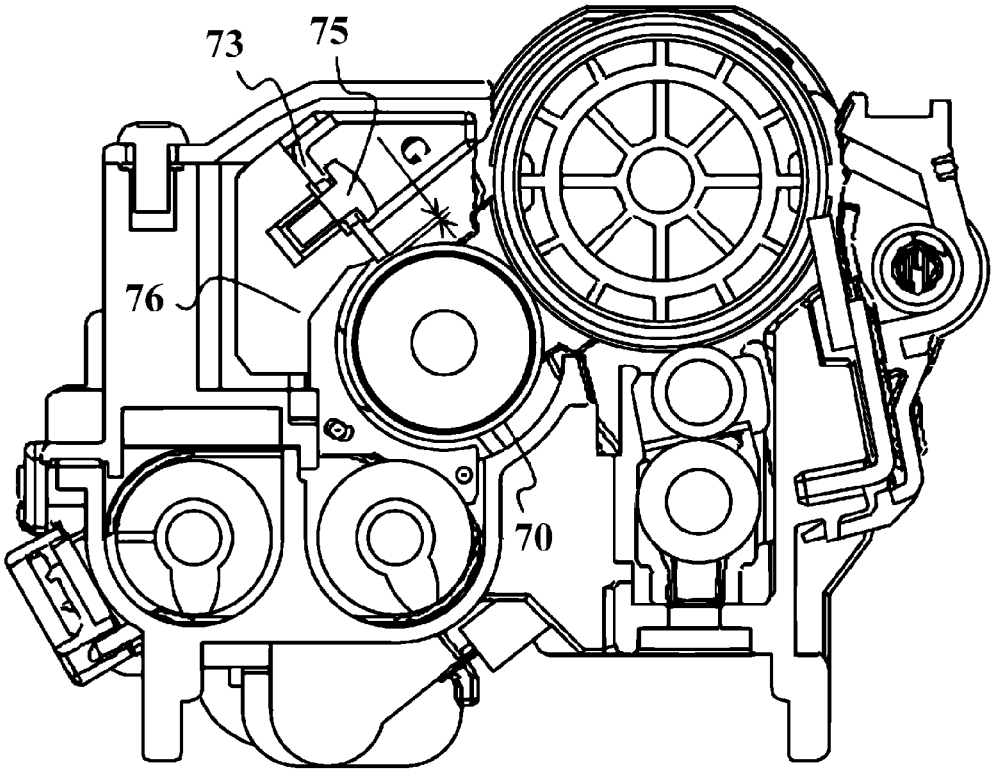
FIG. 11 is a sectional view, of a process cartridge including a developing device, for illustrating a constitution for adjusting an SB gap.

As is apparent from (a) of FIG. 10, Compared with Comparison Example, in this embodiment, even when the radius of curvature R' varies, the coating amount of the developer on the developing sleeve 70 is not readily fluctuated as a whole, so that it is possible to read the effect of the constitution shown in the First Embodiment from this result. Further, when the graph of this embodiment (R=1 mm) is noticed, it is understood that there is a tendency that the coating amount substantially converges to a certain value in a region of R'=0.3 mm and more. This may be attributable to a phenomenon that a resistance when the sidestream Fs shown in (b) of FIG. 8 enters from the stagnation layer 15 is reduced by providing the guiding portion 35*b* having the radius of curvature R' which has a certain magnitude or more and thus smoothly enters the SB gap G.

In FIG. 10, (b) shows supporting data thereof and shows a coating amount difference between environments in developer flow paths of (1) R=0 mm, R'=0 mm (Conventional Example), (2) R=0 mm, R'=0.4 mm (Comparison Example), and (3) R=1 mm, R'=0.4 mm (Second Embodiment). Here, the coating amount difference between environments refers to a value obtained by measuring a weight of the developer coated on the developing sleeve 70 per unit area in each of a low temperature and low humidity environment and a high temperature and high humidity environment and then by calculating a difference between the measured values. A flowability of the developer remarkably changes between the low temperature and low humidity environment and the high temperature and high humidity environment, and therefore in the case where the radius of curvature R' of the guiding portion 35*b* is small, the developer is liable to be caught or the caught developer is abruptly detached from the guiding portion 35*b* to rapidly flow into the SB gap G in some cases.

A difference between (1) R=0 mm, R'=0 mm (Conventional Example) and (2) R=0 mm, R'=0.4 mm (Comparison Example) is an effect by the guiding portion 35*b*, so that the coating amount difference between environment was reduced to about 43%. Further, (3) R=1 mm, R'=0.4 mm is a condition of the flow path wall surface in this embodiment (Second Embodiment), and the coating amount difference between environment was reduced to about 4% with respect to (1) R=0 mm, R'=0 mm (Conventional Example).

As described above, in the case of this embodiment, even when a simple and inexpensive constitution in which part accuracy and adjustment accuracy of the sleeve holder frame 37 or variations thereof at the guiding portion 35*b* of the coating amount regulating portion 36 are alleviated is employed, it is possible to obtain an effect such that the development density is not readily fluctuated.

Other Embodiments

In the above-described embodiments, the case where the present invention is applied to the full-color image forming apparatus of the intermediary transfer tandem type is shown, but the present invention is not limited thereto and is also applicable to a monochromatic image forming apparatus and an image forming apparatus of a direct transfer type. Further, in the above-described embodiments, the example in which the developing device is incorporated into the process cartridge is described, but the present invention is not limited thereto and is also applicable to a developing device singly incorporated in the image forming apparatus.

In the case of the present invention, the developer rectifying surface continuous to the coating amount regulating surface is formed so that the gap with the contact flat plane decreases toward the downstream side of the developer feeding direction and so that the reduction change rate of the gap with the contact flat plane increases toward the downstream side of the developer feeding direction. For this reason, the sidestream such that it pushes back the mainstream of the developer fed by the developer carrying member is reduced, so that instability of the developer coating amount by the influence of the sidestream is suppressed. At the same time, the sidestream such that the developer is supplied toward between the coating amount regulating portion and the developer carrying member is formed, so that the sensitivity of the change in developer coating amount with respect to the change in gap is suppressed. As a result thereof, a stable development density can be obtained without requiring high part accuracy and high adjustment accuracy.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 042703/2013 filed Mar. 5, 2013, which is hereby incorporated by reference.

What is claimed is:

1. A developing device comprising:

a developer carrying member for carrying and feeding a developer;

a regulating portion for regulating an amount of the developer carried on said developer carrying member, wherein said regulating portion includes a flat portion including a closest position where said developer carrying member and said regulating portion are closest to each other; and a guiding portion for guiding a flow of the developer, wherein said guiding portion is connected with an upper end of the flat portion in an upstream side of said regulating portion, with respect to a developer feeding direction, wherein said guiding portion and said regulating portion are integrally molded, and wherein in a cross section perpendicular to an axial direction of said developer carrying member, when coordinates are set such that the upper end of the flat portion is an origin E, a direction which is parallel to a contact flat plane contacting the surface of the developer carrying member and the closest position and which is opposite to the developer feeding direction is a positive side of an X-axis, a direction which is perpendicular to the X-axis and which extends away from said developer carrying member is a positive side of a Y-axis, and a closest distance between said regulating portion and said developer carrying member is G, in a region where a component of the X-axis is 3G or less, said guiding portion if formed by a curve or rectilinear line of 0.2 mm or less, so that a gap between said guiding portion and the contact flat plane monotonically decreases toward the downstream side of the developer feeding direction, and said guiding portion has at least a concavely curved surface such that a rate of a decrease in the gap between said guiding portion and the contact flat plane increases toward a downstream side of the developer feeding direction in the region.

2. A developing device according to claim 1, wherein in the region, at least 50% of said guiding portion has the concavely curved surface.

3. A developing device according to claim 1, wherein in a region where the component of the X-axis is 1.5G or less, said guiding portion has a region where the rate of the decrease in a gap between said guiding portion and the contact flat plane decreases toward the downstream side of the developer feeding direction.

4. A developing device according to claim 1, wherein in a region where a component of each of the X-axis and Y-axis is 5G or less, at least 70% of said guiding portion has the concavely curved surface.

5. A developing device according to claim 1, wherein when a curved surface, such that the rate of the decrease increases toward the downstream side of the developer feeding direction, which is a maximum ellipse inscribed in adjacent two sides of a rectangle consisting of a side having a distance of 3G from the origin E in the positive direction of the X-axis and a side having a distance of 5G from the origin E in the positive direction of the Y-axis is T35, and when a curved surface, such that the rate of the decrease increases toward the downstream side of the developer feeding direction, which is a maximum ellipse inscribed in adjacent two sides of a rectangle consisting of the side having a distance of 5G from the origin E in the positive direction of the X-axis and the side having a distance of 3G from the origin E in the positive direction of the Y-axis is T53, said guiding portion has, in the region where the component of the X-axis is 3G or less, the concavely curved surface with a shape such that the concavely curved surface falls within a space slid along the X-axis or the Y-axis from a space defined by the curved surface T35 and the curved surface T53.

6. A developing device according to claim 1, wherein said guiding portion and said regulating portion are integrally molded with a resin material.

7. A regulating member, provided opposed to a developer carrying member for carrying a developer, for regulating the developer carried on the developer carrying member, said regulating member comprising:

a regulating portion for regulating an amount of the developer carried on the developer carrying member, wherein said regulating portion includes a flat portion including at a closest position where the developer carrying member and said regulating portion are closest to each other; and a guiding portion for guiding a flow of the developer, wherein said guiding portion is connected with an upper end of the flat portion in an upstream side of said regulating portion, with respect to a developer feeding direction, wherein said guiding portion and said regulating portion are integrally molded, wherein in a cross section perpendicular to an axial direction of the developer carrying member, when coordinates are set such that the upper end of the flat portion is an origin E, a direction which is parallel to a contact flat plane contacting the surface of the developer carrying member at the closest portion and which is opposite to the developer feeding direction is a positive side of an X-axis, a direction which is perpendicular to the X-axis and which extends away from the developer carrying member is a positive side of a Y-axis, and a closest distance between said regulating portion and said developer carrying member is G, in a region where a component of the X-axis is 3G or less, said guiding portion is formed by a curve or rectilinear line of 0.2 mm or less, so that a gap between said guiding portion and the contact flat plane monotonically decreases toward the downstream side of the developer feeding direction, and said guiding portion has at least a concavely curved surface such that a rate of a decrease in the gap between said guiding portion and the contact flat plane increases toward a downstream side of the developer feeding direction in the region.

8. A regulating member according to claim 7, wherein in the region, at least 50% of said guiding portion has the concavely curved surface.

9. A regulating member according to claim 7, wherein in a region where the component of the X-axis is 1.5G or less, said guiding portion has a region where the rate of the decrease in a gap between said guiding portion and the contact flat plane decreases toward the downstream side of the developer feeding direction.

10. A regulating member according to claim 7, wherein in a region where a component of each of the X-axis and Y-axis is 5G or less, at least 70% of said guiding portion has the concavely curved surface.

11. A regulating member according to claim 7, wherein when a curved surface, such that the rate of the decrease increases toward the downstream side of the developer feeding direction, which is a maximum ellipse inscribed in adjacent two sides of a rectangle consisting of a side having a distance of 3G from the origin E in the positive direction of the X-axis and a side having a distance of 5G from the origin E in the positive direction of the Y-axis is T35, and when a curved surface, such that the rate of the decrease increases toward the downstream side of the developer feeding direction, which is a maximum ellipse inscribed in adjacent two sides of a rectangle consisting of the side having a distance of 5G from the origin E in the positive direction of the X-axis and the side having a distance of 3G from the origin E in the positive direction of the Y-axis is T53, said guiding portion has, in the region where the component of the X-axis is 3G or less, the concavely curved surface with a shape such that the concavely curved surface falls within a space slid along the X-axis or the Y-axis from a space defined by the curved surface T35 and the curved surface T53.

12. A regulating member according to claim 7, wherein said guiding portion and said regulating portion are integrally molded with a resin material.

13. A developing device comprising:

a developer carrying member for carrying and feeding a developer;

a regulating portion for regulating an amount of the developer carried on said developer carrying member, wherein said regulating portion includes a closest position to a surface of said developer carrying member; and a guiding portion for guiding a flow of the developer, wherein said guiding portion is connected with the closest position in an upstream side of said regulating portion, with respect to a developer feeding direction, wherein said guiding portion and said regulating portion are integrally molded, wherein in a cross section perpendicular to an axial direction of said developer carrying member, when coordinates are set such that the closest position is an origin E, a direction which is parallel to a contact flat plane contacting the surface of the developer carrying member at the closest position and which is opposite to the developer feeding direction is a positive side of an X axis, a direction which is perpendicular to the X axis and which extends away from said developer carrying member is a positive side of a Y axis, and a closest distance between said regulating portion and said developer carrying member is G, in a region where a component of the X axis is 3G or less, wherein said guiding portion is formed by a curve or rectilinear line of 0.2 mm or less, so that a gap between said guiding portion and the contact flat plane monotonically decreases toward the downstream side of the developer feeding direction, and said guiding portion has at least a concavely curved surface such that a rate of a decrease in the gap between said guiding portion and the contact flat plane increases toward a downstream side of the developer feeding direction in the region.

14. A developing device according to claim 13, wherein in the region, at least 50% of said guiding portion has the concavely curved surface.

15. A developing device according to claim 13, wherein in a region where the component of the X axis is 1.5G or less, said guiding portion has a region where the rate of the decrease in a gap between said guiding portion and the contact flat plane decreases toward the downstream side of the developer feeding direction.

16. A developing device according to claim 13, wherein in a region where a component of each of the X axis and Y axis is 5G or less, at least 70% of said guiding portion has the concavely curved surface.

17. A developing device according to claim 13, wherein when a curved surface, such that the rate of the decrease increases toward the downstream side of the developer feeding direction, which is a maximum ellipse inscribed in adjacent two sides of a rectangle consisting of a side having a distance of 3G from the origin E in the positive direction of the X axis and a side having a distance of 5G from the origin E in the positive direction of the Y axis is T35, and when a curved surface, such that the rate of the decrease increases toward the downstream side of the developer feeding direction, which is a maximum ellipse inscribed in adjacent two sides of a rectangle consisting of the side having a distance of 5G from the origin E in the positive direction of the X axis and the side having a distance of 3G from the origin E in the positive direction of the Y axis is T53, said guiding portion has, in the region where the component of the X axis is 3G or less, the concavely curved surface with a shape such that the concavely curved surface falls within a space slid along the X axis or the Y axis from a space defined by the curved surface T35 and the curved surface T53.

18. A developing device according to claim 13, wherein said guiding portion and said regulating portion are integrally molded with a resin material.

19. A regulating member, provided opposed to a developer carrying member for carrying a developer, for regulating the developer carried on the developer carrying member, said regulating member comprising:

a regulating portion for regulating an amount of the developer carried on the developer carrying member, wherein said regulating portion includes a closest position to a surface of the developer carrying member; and a guiding portion for guiding a flow of the developer, wherein said guiding portion is connected with the closest position in an upstream side of said regulating portion, with respect to a developer feeding direction, wherein said guiding portion and said regulating portion are integrally molded, wherein in a cross section perpendicular to an axial direction of said developer carrying member, when coordinates are set such that the closest position is an origin E, a direction which is parallel to a contact flat plane contacting the surface of the developer carrying member at the closest position and which is opposite to the developer feeding direction is a positive side of an X axis, a direction which is perpendicular to the X axis and which extends away from the developer carrying member is a positive side of a Y axis, and a closest distance between said regulating portion and the developer carrying member is G, in a region where a component of the X axis is 3G or less, said guiding portion is formed by a curve or rectilinear line of 0.2 mm or less, so that a gap between said guiding portion and the contact flat plane monotonically decreases toward the downstream side of the developer feeding direction, and said guiding portion has at least a concavely curved surface such that a rate of a decrease in the gap between said guiding portion and the contact flat plane increases toward a downstream side of the developer feeding direction in the region.

20. A regulating member according to claim 19, wherein in the region, at least 50% of said guiding portion has the concavely curved surface.

21. A regulating member according to claim 19, wherein in a region where the component of the X axis is 1.5G or less, said guiding portion has a region where the rate of the decrease in a gap between said guiding portion and the contact flat plane decreases toward the downstream side of the developer feeding direction.

22. A regulating member according to claim 19, wherein in a region where a component of each of the X axis and Y axis is 5G or less, at least 70% of said guiding portion has the concavely curved surface.

23. A regulating member according to claim 19, wherein when a curved surface, such that the rate of the decrease increases toward the downstream side of the developer feeding direction, which is a maximum ellipse inscribed in adjacent two sides of a rectangle consisting of a side having a distance of 3G from the origin E in the positive direction of the X axis and a side having a distance of 5G from the origin E in the positive direction of the Y axis is T35 and when a curved surface, such that the rate of the decrease increases toward the downstream side of the developer feeding direction, which is a maximum ellipse inscribed in adjacent two sides of a rectangle consisting of the side having a distance of 5G from the origin E in the positive direction of the X axis and the side having a distance of 3G from the origin E in the positive direction of the Y axis is T53, said guiding portion has, in the region where the component of the X axis is 3G or less, the concavely curved surface with a shape such that the concavely curved surface falls within a space slid along the X axis or the Y axis from a space defined by the curved surface T35 and the curved surface T53.

24. A regulating member according to claim 19, wherein said guiding portion and said regulating portion are integrally molded with a resin material.

* * * * *